United States Patent [19]

Yoshizawa et al.

[11] Patent Number: 4,881,989

[45] Date of Patent: Nov. 21, 1989

[54] FE-BASE SOFT MAGNETIC ALLOY AND METHOD OF PRODUCING SAME

[75] Inventors: Yoshihito Yoshizawa; Kiyotaka Yamauchi; Shigeru Oguma, all of Kumagaya, Japan

[73] Assignee: Hitachi Metals, Ltd., Tokyo, Japan

[21] Appl. No.: 103,250

[22] Filed: Oct. 1, 1987

[30] Foreign Application Priority Data

Dec. 15, 1986 [JP] Japan ..... 61-297938
Mar. 13, 1987 [JP] Japan ..... 62-58577
Jun. 1, 1987 [JP] Japan ..... 62-137995

[51] Int. Cl.[4] ..... C22C 38/16; H01F 1/02

[52] U.S. Cl. ..... 148/302; 148/303; 148/307; 420/83; 420/89

[58] Field of Search ..... 148/301, 302, 303, 305, 148/306, 307, 308, 310, 311; 420/83, 89

[56] References Cited

U.S. PATENT DOCUMENTS 4,581,080 4/1986 Meguro et al. ..... 148/307

FOREIGN PATENT DOCUMENTS 0125347 11/1984 European Pat. Off. ..... 148/302

*Primary Examiner*—L. Dewayne Rutledge
*Assistant Examiner*—George Wyszomierski
*Attorney, Agent, or Firm*—Sughrue, Mion, Zinn, Macpeak & Seas

[57] ABSTRACT

An Fe-base soft magnetic alloy having the composition represented by the general formula:

$$(Fe_{1-a}M_a)_{100-x-y-z-\alpha-\beta-\gamma}Cu_xSi_yB_zM'_\alpha M''_\beta X_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$, $\beta \leqq 10$ and $\gamma \leqq 10$, at least 50% of the alloy structure being fine crystalline particles having an average particle size of 1000 Å or less. This alloy has low core loss, time variation of core loss, high permeability and low magnetostriction.

27 Claims, 32 Drawing Sheets

EFFECTIVE PERMEABILITY $\mu_{eix}$ OF Fe-Cu1-Nb3-Si-B ALLOY

200Å

200 Å

COERCIVE FORCE Hc OF Fe-Cu1-Nb3-Si-B ALLOY

EFFECTIVE PERMEABILITY $\mu e_{1k}$ OF
$Fe-Cu_1-Nb_3-Si-B$ ALLOY $B_{800}$ (≈Bs) OF
$Fe-Cu_1-Nb_3-Si-B$ ALLOY

CORE LOSS W2/100k OF
Fe-Cu1-Nb3-Si-B ALLOY

FE-BASE SOFT MAGNETIC ALLOY AND METHOD OF PRODUCING SAME

BACKGROUND OF THE INVENTION

The present invention relates to an Fe-base soft magnetic alloy having excellent magnetic properties, and more particularly to an Fe-base soft magnetic alloy having a low magnetostriction suitable for various transformers, choke coils, saturable reactors, magnetic heads, etc. and methods of producing them.

Conventionally used as magnetic materials for high-frequency transformers, magnetic heads, saturable reactors, choke coils, etc. are mainly ferrites having such advantages as low eddy current loss. However, since ferrites have a low saturation magnetic flux density and poor temperature characteristics, it is difficult to miniaturize magnetic cores made of ferrites for high-frequency transformers, choke coils etc.

Thus, in these applications, alloys having particularly small magnetostriction are desired because they have relatively good soft magnetic properties even when internal strain remains after impregnation, molding or working, which tend to deteriorate magnetic properties thereof. As soft magnetic alloys having small magnetostriction, 6.5-weight % silicone steel, Fe-Si-Al alloy, 80-weight % Ni Permalloy, etc. are known, which have saturation magnetostriction $\lambda s$ of nearly 0.

However, although the silicone steel has a high saturation magnetic flux density, it is poor in soft magnetic properties, particularly in permeability and core loss at high frequency. Although Fe-Si-Al alloy has better soft magnetic properties than the silicone steel, it is still insufficient as compared with Co-base amorphous alloys, and further since it is brittle, its thin ribbon is extremely difficult to wind or work. 80-weight % Ni Permalloy has a low saturation magnetic flux density of about 8 KG and a small magnetostriction, but it is easily subjected to plastic deformation which serves to deteriorate its characteristics.

Recently, as an alternative to such conventional magnetic materials, amorphous magnetic alloys having a high saturation magnetic flux density have been atracting much attention, and those having various compositions have been developed. Amorphous alloys are mainly classified into two categories: iron-base alloys and cobalt-base alloys. Fe-base amorphous alloys are advantageous in that they are less expensive than Co-base amorphous alloys, but they generally have larger core loss and lower permeability at high frequency than the Co-base amorphous alloys. On the other hand, despite the fact that the Co-base amorphous alloys have small core loss and high permeability at high frequency, their core loss and permeability vary largerly as the time passes, posing problems in practical use. Further, since they contain as a main component an expensive cobalt, they are inevitably disadvantageous in terms of cost.

Under such circumstances, various proposals have been made on Fe-base soft magnetic alloys.

Japanese Patent Publication No. 60-17019 discloses an iron-base, boron-containing magnetic amorphous alloy having the composition of 74–84 atomic % of Fe, 8–24 atomic % of B and at least one of 16 atomic % or less of Si and 3 atomic % or less of C, at least 85% of its structure being in the form of an amorphous metal matrix, crystalline alloy particle precipitates being discontinuously distributed in the overall amorphous metal matrix, the crystalline perticles having an average particle size of 0.05–1 μm and an average particle-to-particle distance of 1–10 μm, and the particles occupying 0.01–0.3 of the total volume. It is reported that the crystalline particles in this alloy are α-(Fe, Si) particles discontinuously distributed and acting as pinning sites of magnetic domain walls. However, despite the fact that this Fe-base amorphous magnetic alloy has a low core loss because of the presence of discontinuous crystalline particles, the core loss is still large for intended purposes, and its permeability does not reach the level of Co-base amorphous alloys, so that it is not satisfactory as magnetic core material for high-frequency transformers and chokes intended in the present invention.

Japanese Patent Laid-Open No.60-52557 discloses a low-core loss, amorphous magnetic alloy having the formula $Fe_aCu_bB_cSi_d$, wherein $75 \leqq a \leqq 85$, $0 \leqq b \leqq 1.5$, $10 \leqq c \leqq 20$; $d \leqq 10$ and $c+d \leqq 30$. However, although this Fe-base amorphous alloy has an extremely reduced core loss because of Cu, it is still unsatisfactory like the above Fe-base amorphous alloy containing crystalline particles. Further, it is not satisfactory in terms of the time variability of core loss, permeability, etc.

Further, an attempt has been made to reduce magnetostriction and also core loss by adding Mo or Nb (Inomata et al., J. Appl. Phys. 54(11), Nov. 1983, pp. 6553–6557).

However it is known that in the case of an Fe-base amorphous alloy, a saturation magnetostriction $\lambda s$ is almost in proportion to the square of a saturation magnetization Ms (Makino, et al., Japan Applied Magnetism Association, The 4th Convention material (1978), 43), which means that the magnetostriction cannot be made close to zero without reducing the saturation magnetization to almost zero. Alloys having such composition have extremely low Curie temperatures, unable to be used for practical purposes. Thus, Fe-base amorphous alloys presently used do not have sufficiently low magnetostriction, so that when impregnated with resins, they have deteriorated soft matnetic characteristics which are extremely inferior to those of Co-base amorphous alloys.

OBJECT AND SUMMARY OF THE INVENTION

Therefore, an object of the present invention is to provide an Fe-base soft magnetic alloy having excellent magnetic characteristics such as core loss, time variability of core loss, permeability, etc.

Another object of the present invention is to provide an Fe-base soft magnetic alloy having excellent soft magnetic properties, particularly high-frequency magnetic properties, and also a low magnetostriction which keeps it from suffering from magnetic deterioration by impregnation and deformation.

A further object of the present invention is to provide a method of producing such Fe-base soft magnetic alloys.

Intense research in view of the above objects has revealed that the addition of Cu and at least one element selected from the group consisting of Nb, W, Ta, Zr, Hf, Ti and Mo to an Fe-base alloy having an essential composition of Fe-Si-B, and a proper heat treatment of the Fe-base alloy which is once made amorphous can provide an Fe-base soft magnetic alloy, a major part of which structure is composed of fine crystalline particles, and thus having excellent soft magnetic properties. It has also been found that by limiting the alloy composition properly, the alloy can have a low magnetostriction. The present invention is based on these findings.

Thus, the Fe-base soft magnetic alloy according to the present invention has the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti and Mo, and a, x, y, z and $\alpha$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$ and $0.1 \leqq \alpha \leqq 30$, at least 50% of the alloy structure being occupied by fine crystalline particles.

Another Fe-base soft magnetic alloy according to the present invention has the composition represented by the general formula:

$$(Fe_{1-a}M_a)_{100-x-y-z-\alpha-\beta-\gamma}Cu_xSi_yB_zM'_\alpha M''_\beta X_\gamma$$

wherein is M is Co and/or Ni, M' is at least one element selected from the group consisting of Nb, W, Ta, Zr, Hf, Ti and Mo, Mn'' is at least one element selected from the group consisting of V, Cr, Mn, Al, elements in the platinum group, Sc, Y, rare earth elements, Au, Zn, Sn and Re, X is at least one element selected from the group consisting of C. Ge, P, Ga, Sb, In, Be and As, and a, x, y, z, $\alpha$, $\beta$ and $\gamma$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$ $\beta \leqq 10$ and $\gamma \leqq 10$, at least 50% of the alloy structure being fine crystalline particles having an average particle size of 1000 Å or less.

Further, the method of producing an Fe-base soft magnetic alloy according to the present invention comprises the steps of rapidly quenching a melt of the above composition and heat treating it to generate fine crystalline particles.

BRIEF DESCRIPTION OF THE DRAWINGS

FIG. 1 (*b*) is a schematic view of the photomicrograph of FIG. 1 (*a*);

FIG. 1 (*c*) is a transmission electron photomicrograph (magnification: 300,000) of the Fe-base soft magnetic alloy of $Fe_{74.5}Nb_3Si_{13.5}B_9$ containing no Cu after heat treatment;

FIG. 1 (*d*) is a schematic view of the photomicrograph of FIG. 1 (*c*);

FIG. 3 (*b* ) is a graph showing an X-ray diffraction pattern of the Fe-base soft magnetic alloy of the present invention after heat treatment;

DETAILED DESCRIPTION OF THE INVENTION

Figure 1A:
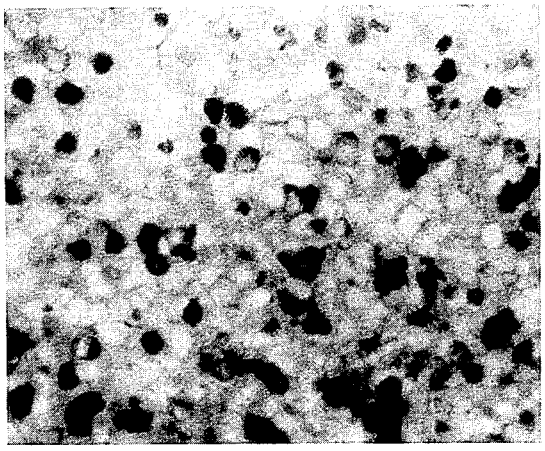
FIG. 1 (*a*) is a transmission electron photomicroscope (magnification: 300,000) of the Fe-base soft magnetic alloy after heat treatment in Example 1.
Figure 1B:
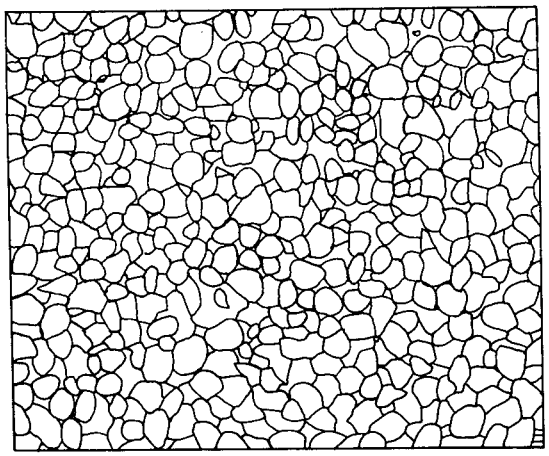
Figure 1C:
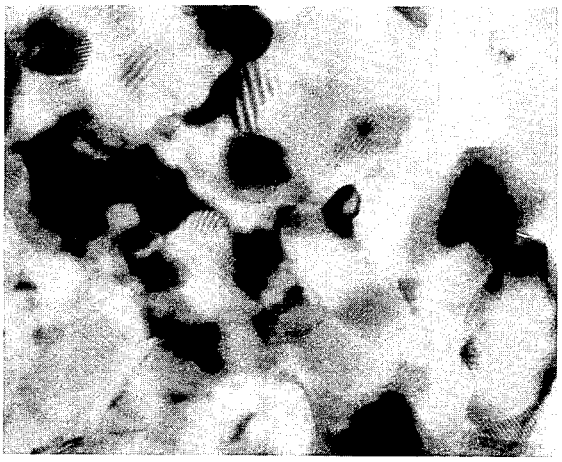
Figure 1D:
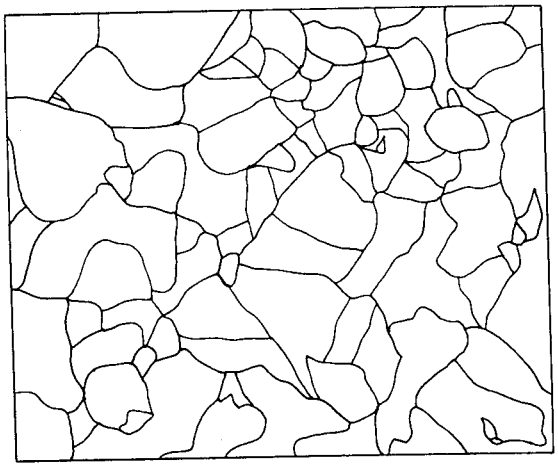

In the Fe-base soft magnetic alloy of the present invention, Fe may be substituted by Co and/or Ni in the range of 0–0.5. However, to have good magnetic properties such as low core loss and magnetostriction, the content of Co and/or Ni which is represented by "a" is preferably 0–0.1. Particularly to provide a low-magnetostriction alloy, the range of "a" is preferably 0–0.05.

In the present invention, Cu is an indispensable element, and its content "x" is 0.1–3 atomic %. When it is less than 0.1 atomic %, substantially no effect on the reduction of core loss and on the increase in permeability can be obtained by the addition of Cu. On the other hand, when it exceeds 3 atomic %, the alloy's core loss becomes larger than those containing no Cu, reducing the permeability, too. The preferred content of Cu in the present invention is 0.5–2 atomic %, in which range the core loss is particularly small and the permeability is high.

The reasons why the core loss decreases and the permeability increases by the addition of Cu are not fully clear, but it may be presumed as follows:

Cu and Fe have a positive interaction parameter so that their solubility is low. However, since iron atoms or copper atoms tend to gather to form clusters, thereby producing compositional fluctuation. This produces a lot of domains likely to be crystallized to provide nuclei for generating fine crystalline particles. These crystalline particles are based on Fe, and since Cu is substantially not soluble in Fe, Cu is ejected from the fine crystalline particles, whereby the Cu content in the vicinity of the crystalline particles becomes high. This presumably suppresses the growth of crystalline particles.

Because of the formation of a large number of nuclei and the suppression of growth of crystalline particles by the addition of Cu, the crystalline particles are made fine, and this phenomenon is accelerated by the inclusion of Nb, Ta, W, Mo, Zr, Hf, Ti, etc.

Without Nb, Ta, W, Mo, Zr, Hf, Ti, etc., the crystalline particles are not fully made fine and thus the soft magnetic properties of the resulting alloy are poor. Particularly Nb and Mo are effective, and particularly Nb acts to keep the crystalline particles fine, thereby providing excellent soft magnetic properties. And since a fine crystalline phase based on Fe is formed, the Fe-base soft magnetic alloy of the present invention has smaller magnetostriction than Fe-base amorphous alloys, which means that the Fe-base soft magnetic alloy of the present invention has smaller magnetic anisotropy due to internal stress-strain, resulting in improved soft magnetic properties.

Without the addition of Cu, the crystalline particles are unlikely to be made fine. Instead, a compound phase is likely to be formed and crystallized, thereby deteriorating the magnetic properties.

Si and B are elements particularly for making fine the alloy structure. The Fe-base soft magnetic alloy of the present invention is desirably produced by once forming an amorphous alloy with the addition of Si and B, and then forming fine crystalline particles by heat treatment.

The content of Si ("y") and that of B ("z") are $0 \leqq y \leqq 30$ atomic %, $0 \leqq z \leqq 25$ atomic %, and $5 \leqq y+z \leqq 30$ atomic %, because the alloy would have an extremely reduced saturation magnetic flux density if otherwise.

In the present invention, the preferred range of y is 6–25 atomic %, and the preferred range of z is 2–25 atomic %, and are preferred of $y+z$ is 14–30 atomic %. When y exceeds 25 atomic %, the resulting alloy has a relatively large magnetostriction under the condition of good soft magnetic properties, and when y is less than 6 atomic %, sufficient soft magnetic properties are not necessarily obtained. The reasons for limiting the content of B ("z") is that when z is less than 2 atomic %, uniform crystalline particle structure cannot easily be obtained, somewhat deteriorating the soft magnetic properties, and when z exceeds 25 atomic %, the resulting alloy would have a relatively large magnetostriction under the heat treatment condition of providing good soft magnetic properties. With respect to the total amount of $Si+B$ $(y+z)$, when $y+z$ is less than 14 atomic %, it is often difficult to make the alloy amorphous, providing relatively poor magnetic properties, and when $y+z$ exceeds 30 atomic % an extreme decrease in a saturation magnetic flux density and the deterioration of soft magnetic properties and the increase in magnetostriction ensue. More preferably, the contents of Si and B are $10 \leqq y \leqq 25$, $3 \leqq z \leqq 18$ and $18 \leqq y+z \leqq 28$, and this range provides the alloy with excellent soft magnetic properties, particularly a saturation magnetostriction in the range of $-5 \times 10^{-6} - +5 \times 10^{-6}$. Particularly preferred range is $11 \leqq y \leqq 24$, $3 \leqq z \leqq 9$ and $18 \leqq y+z \leqq 27$, and this range provides the alloy with a saturation magnetostriction in the range of $-1.5 \times 10^{-6} - +1.5 \times 10^{-6}$.

In the present invention, M' acts when added together with Cu to make the precipitated crystalline particles fine. M' is at least one element selected from the group consisting of Nb, W, Ta, Zr, Hf, Ti and Mo. These elements have a function of elevating the crystallization temperature of the alloy, and synergistically with Cu having a function of forming clusters and thus lowering the crystallization temperature, it suppresses the growth of the precipitated crystalline particles, thereby making them fine.

The content of M' ($\alpha$) is 0.1–30 atomic %. When it is less than 0.1 atomic %, sufficient effect of making crystalline particles fine cannot be obtained, and when it exceeds 30 atomic % an extreme decrease in saturation magnetic flux density ensues. The preferred content of M' is 0.1–10 atomic %, and more preferably $\alpha$ is 2–8 atomic %, in which range particularly excellent soft magnetic properties are obtained. Incidentally, most preferable as M' is Nb and/or Mo, and particularly Nb in terms of magnetic properties. The addition of M' provides the Fe-base soft magnetic alloy with as high permeability as that of the Co-base, high-permeability materials.

M'', which is at least one element selected from the group consisting of V, Cr, Mn, Al, elements in the platinum group, Sc, Y, rare earth elements, Au, Zn, Sn and Re, may be added for the purposes of improving corrosion resistance or magnetic properties and of adjusting magnetostriction, but its content is at most 10 atomic %. When the content of M'' exceeds 10 atomic %, an extremely decrease in a saturation magnetic flux density ensues. A particularly preferred amount of M'' is 5 atomic % or less.

Among them, at least one element selected from the group consisting of Ru. Rh, Pd. Os, Ir, Pt, Au, Cr and V is capable of providing the alloy with particularly excellent corrosion resistance and wear resistance, thereby making it suitable for magnetic heads, etc.

The alloy of the present invention may contain 10 atomic % or less of at least one element X selected from the group consisting of C, Ge, P, Ga, Sb, In, Be, As. These elements are effective for making amorphous, and when added with Si and B, they help make the alloy amorphous and also are effective for adjusting the magnetostriction and Curie temperature of the alloy. In sum, in the Fe-base soft magnetic alloy having the general formula:

$$(Fe_{1-a}M_a)_{100-x-y-z-\alpha}Cu_xSi_yB_zM'_\alpha,$$

the general ranges of a, x, y, z and $\alpha$ are $0 \leqq a \leqq 0.5$
$0.1 \leqq x \leqq 3$
$0 \leqq y \leqq 30$
$0 \leqq z \leqq 25$
$5 \leqq y+z \leqq 30$
$0.1 \leqq \alpha \leqq 30,$ and the preferred ranges thereof are $0 \leqq a \leqq 0.1$
$0.1 \leqq x \leqq 3$
$6 \leqq y \leqq 25$
$2 \leqq z \leqq 25$
$14 \leqq y+z \leqq 30$
$0.1 \leqq \alpha \leqq 10,$ and the more preferable ranges are $0 \leqq a \leqq 0.1$
$0.5 \leqq x \leqq 2$
$10 \leqq y \leqq 25$
$3 \leqq z \leqq 18$
$18 \leqq y+z \leqq 28$
$2 \leqq \alpha \leqq 8,$ and the most preferable ranges are $0 \leqq a \leqq 0.05$
$0.5 \leqq x \leqq 2$
$11 \leqq y \leqq 24$
$3 \leqq z \leqq 9$
$18 \leqq y+z \leqq 27$
$2 \leqq \alpha \leqq 8.$ And in the Fe-base soft magnetic alloy having the general formula:

$$(Fe_{1-a}M_a)_{100-x-y-z-\alpha-\beta-\gamma}Cu_xSi_yB_zM'_\alpha M''_\beta X_\gamma,$$

the general ranges of a, x, y, z, $\alpha$, $\beta$ and $\gamma$ are $0 \leqq a \leqq 0.5$
$0.1 \leqq x \leqq 3$
$0 \leqq y \leqq 30$
$0 \leqq z \leqq 25$
$5 \leqq y+z \leqq 30$
$0.1 \leqq \alpha \leqq 30$
$\beta \leqq 10$
$\gamma \leqq 10,$ and the preferred ranges are $0 \leqq a \leqq 0.1$
$0.1 \leqq x \leqq 3$
$6 \leqq y \leqq 25$
$2 \leqq z \leqq 25$
$14 \leqq y+z \leqq 30$
$0.1 \leqq \alpha \leqq 10$
$\beta \leqq 5$
$\gamma \leqq 5,$ and the more preferable ranges are $0 \leqq a \leqq 0.1$
$0.5 \leqq x \leqq 2$
$10 \leqq y \leqq 25$
$3 \leqq z \leqq 18$
$18 \leqq y+z \leqq 28$
$2 \leqq \alpha \leqq 8$
$\beta \leqq 5$
$\gamma \leqq 5,$ and the most preferable ranges are $0 \leqq a \leqq 0.05$
$0.5 \leqq x \leqq 2$
$11 \leqq y \leqq 24$
$3 \leqq z \leqq 9$
$18 \leqq y+z \leqq 27$
$2 \leqq \alpha \leqq 8$
$\beta \leqq 5$
$\gamma \leqq 5.$ The Fe-base soft magnetic alloy having the above composition according to the present invention has an alloy structure, at least 50% of which consists of fine crystalline -particles. These crystalline particles are based on $\alpha$-Fe having a bcc structure, in which Si and B. etc. are dissolved. These crystalline particles have an extremely small average particle size of 1000Å or less, and are uniformly distributed in the alloy structure. Incidentally, the average paticle size of the crystalline particles is determined by measuring the maximum size of each particle and averaging them. When the average particle size exceeds 1000 Å, good soft magnetic properties are not obtained. It is preferably 500 Å or less, more preferably 200 Å or less and particularly 50–200 Å. The remaining portion of the alloy structure other than the fine crystalline particles is mainly amorphous. Even with fine crystalline particles occupying substantially 100% of the alloy structure, the Fe base soft magnetic alloy of the present invention has sufficiently good magnetic properties.

Incidentally, with respect to inevitable impurities such as N, O, S, etc., it is to be noted that the inclusion thereof in such amounts as not to deteriorate the desired properties is not regarded as changing the alloy composition of the present invention suitable for magnetic cores, etc.

Next, the method of producing the Fe-base soft magnetic alloy of the present invention will be explained in detail below.

First, a melt of the above composition is rapidly quenched by known liquid quenching methods such as a single roll method, a double roll method, etc, to form amorphous alloy ribbons. Usually amorphous alloy ribbons produced by the single roll method, etc. have a thickness of 5–100 μm or so, and those having a thickness of 25 μm or less are particularly suitable as magnetic core materials for use at high frequency.

These amorphous alloys may contain crystal phases, but the alloy structure is preferably amorphous to make sure the formation of uniform fine crystalline particles by a subsequent heat treatment. Incidentally, the alloy of the present invention can be produced directly by the liquid quenching method without resorting to heat treatment, as long as proper conditions are selected.

The amorphous ribbons are wound, punched, etched or subjected to any other working to desired shapes before heat treatment, for the reasons that the ribbons have good workability in an amorphous state, but that once crystallized they lose workability.

The heat treatment is carried out by heating the amorphous alloy ribbon worked to have the desired shape in vaccum or in an inert gas atmosphere such as hydrogen, nitrogen, argon, etc. The temperature and time of the heat treatment varies depending upon the composition of the amorphous alloy ribbon and the shape and size of a magnetic core made from the amorphous alloy ribbon, etc., but in general it is preferably 450°–700° C. for 5 minutes to 24 hours. When the heat treatment temperature is lower than 450° C., crystallization is unlikely to take place with ease, requiring too much time for the heat treatment. On the other hand, when it exceeds 700° C., coarse crystalline particles tend to be formed, making it difficult to obtain fine crystalline particles. And with respect to the heat treatment time, when it is shorter than 5 minutes, it is difficult to heat the overall worked alloy at uniform temperature, providing uneven magnetic properties, and when it is longer than 24 hours, productivity becomes too low and also the crystalline particles grow excessively, resulting in the deterioration of magnetic properties. The preferred heat treatment conditions are, taking into consideration practicality and uniform temperature control, etc., 500°–650° C. for 5 minutes to 6 hours.

The heat treatment atmosphere is preferably an inert gas atmosphere, but it may be an oxidizing atmosphere such as the air. Cooling may be carried out properly in the air or in a furnace. And the heat treatment may be conducted by a plurality of steps.

The heat treatment can be carried out in a magnetic field to provide the alloy with magnetic anisotropy. When a magnetic field is applied in parallel to the magnetic path of a magnetic core made of the alloy of the present invention in the heat treatment step, the resulting heat-treated magnetic core has a good squareness in a B-H curve thereof, so that it is particularly suitable for saturable reactors, magnetic switches, pulse compression cores, reactors for preventing spike voltage, etc. On the other hand, when the heat treatment is conducted while applying a magnetic field in perpendicular to the magnetic path of a magnetic core, the B-H curve inclines, providing it with a small squareness ratio and a constant permeability. Thus, it has a wider operational range and thus is suitable for transformers, noise filters, choke coils, etc.

The magnetic field need not be applied always during the heat treatment, and it is -necessary only when the alloy is at a temperature lower than the Curie temperature Tc thereof. In the present invention, the alloy has an elevated Curie temperature because of crystallization than the amorphous counterpart, and so the heat treatment in a magnetic field can be carried out at temperatures higher than the Curie temperature of the corresponding amorphous alloy. In a case of the heat treatment in a magnetic field, it may be carried out by two or more steps. Also, a rotational magnetic field can be applied during the heat treatment.

Incidentally, the Fe-base soft magnetic alloy of the present invention can be produced by other methods than liquid quenching methods, such as vapor deposition, ion plating, sputtering. etc. which are suitable for producing thin-film magnetic heads, etc. Further, a rotation liquid spinning method and a glass-coated spinning method may also be utilized to produce thin wires.

In addition, powdery products can be produced by a cavitation method, an atomization method or by pulverizing thin ribbons prepared by a single roll method, etc.

Such powdery alloys of the present invention can be compressed to produce dust cores or bulky products.

When the alloy of the present invention is used for magnetic cores, the surface of the alloy is preferably coated with an oxidation layer by proper heat treatment or chemical treatment, or coated with an insulating layer to provide insulation between the adjacent layers so that the magnetic cores may have good properties.

The present invention will be explained in detail by the following Examples, without intention of restricting the scope of the present invention.

EXAMPLE 1

Figure 2:
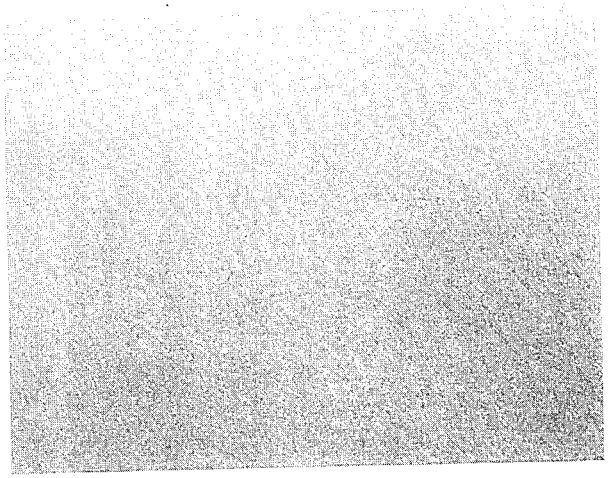
FIG. 2 is a transmission electron photomicrograph (magnification: 300,000) of the Fe-base soft magnetic alloy of Example 1 before heat treatment.

A melt having the composition (by atomic %) of 1% Cu, 13.4% Si, 9.1% B, 3.1% Nb and balance substantially Fe was formed into a ribbon of 5 mm in width and 18 μm in thickness by a single roll method. The X-ray diffraction of this ribbon showed a halo pattern peculiar to an amorphous alloy. A transmission electron photomicrograph (magnification: 300,000) of this ribbon is shown in FIG. 2. As is clear from the X-ray diffraction and FIG. 2, the resulting ribbon was almost completely amorphous.

Next, this amorphous ribbon was formed into a toroidal wound core of 15 mm in inner diameter and 19 mm in outer diameter, and then heat-treated in a nitrogen gas atmosphere at 550° C. for one hour. FIG. 1(*a*) shows a transmission electron photomicrograph (magnification: 300,000) of the heat-treated ribbon. FIG. 1(*b*) schematically shows the fine crystalline particles in the photomicrograph of FIG. 1(*a*). It is evident from FIGS. 1 (*a*) and (*b*) that most of the alloy structure of the ribbon after the heat treatment consists of fine crystalline particles. It was also confirmed by X-ray diffraction that the alloy after the heat treatment had crystalline particles. The crystalline particles had an average particle size of about 100 Å. For comparison, FIG. 1(*c*) shows a transmission electron photomicrograph (magnification: 300,000) of an amorphous alloy of $Fe_{74.5}Nb_3Si_{13.5}B_9$ containing no Cu which was heat-treated at 550° C. for 1 hour, and FIG. 1(*d*) schematically shows its crystalline particles.

The alloy of the present invention containing both Cu and Nb contains crystalline particles almost in a spherical shape having an average particle size of about 100 Å. On the other hand, in alloys containing only Nb without Cu, the crystalline particles are coarse and most of them are not in the spherical shape. It was confirmed that the addition of both Cu and Nb greatly affects the size and shape of the resulting crystalline particles.

Next, the Fe-base soft magnetic alloy ribbons before and after the heat treatment were measured with respect to core loss $W_{2/100k}$ at a wave height of magnetic flux density Bm=2 kG and a frequency of 100 kHz. As a result, the core loss was 4000 mW/cc before the heat treatment, while it was 220 mW/cc after the heat treatment. Effective permeability $\mu e$ was also measured at a frequency of 1 kHz and Hm of 5 mOe. As a result, the former (before the heat treatment) was 500, while the latter (after the heat treatment) was 100200. This clearly shows that the heat treatment according to the present invention serves to form fine crystalline particles uniformly in the amorphous alloy structure, thereby extremely lowering core loss and enhancing permeability.

EXAMPLE 2

Figure 3:
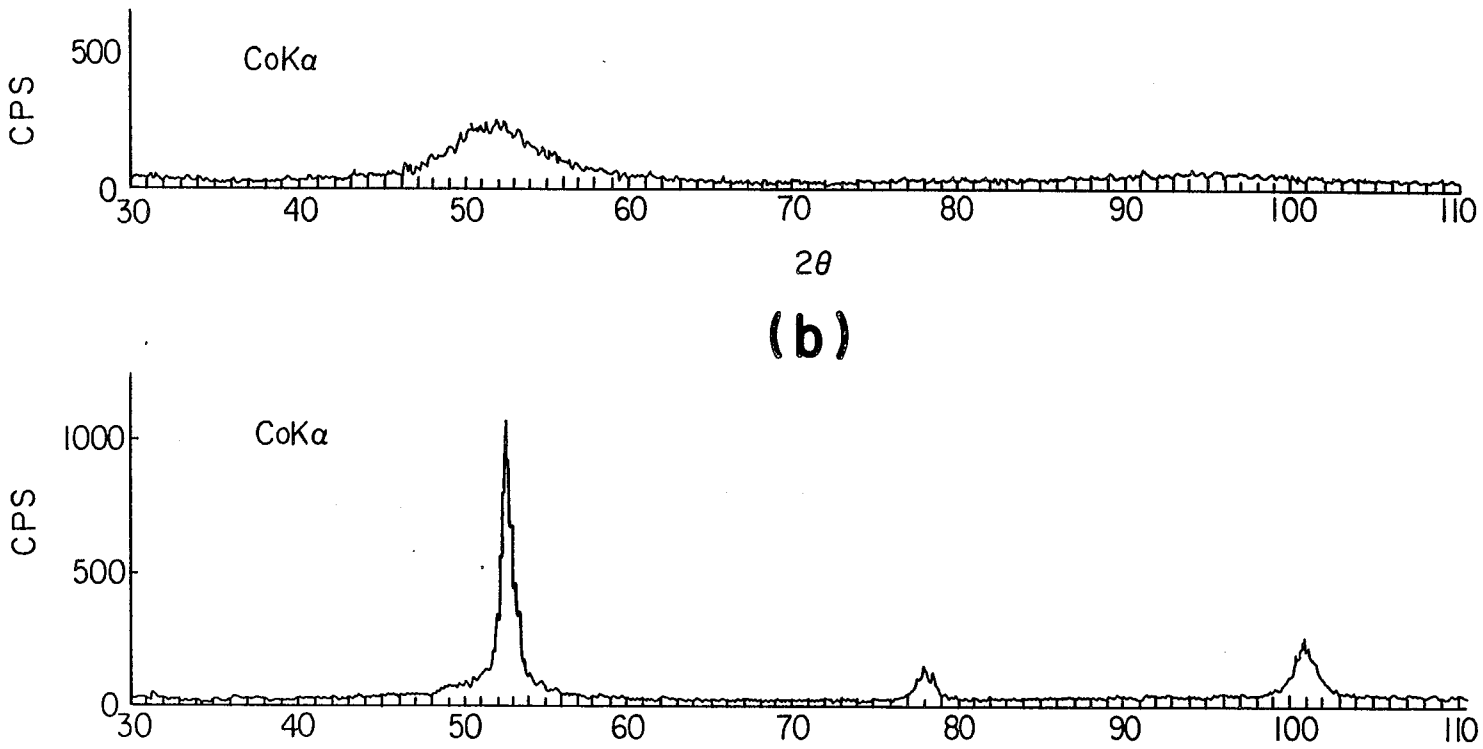
FIG. 3 (*a*) is a graph showing an X-ray diffraction pattern of the Fe-base soft magnetic alloy of Example 1 before heat treatment.

A melt having the composition (by atomic %) of 1% Cu, 15% Si, 9% B, 3% Nb, 1% Cr and balance substantially Fe was formed into a ribbon of 5 mm in width and 18 μm in thickness by a single roll method. The X-ray diffraction of this ribbon showed a halo pattern peculiar to an amorphous alloy as is shown in FIG. 3(*a*). As is clear from a transmission electron photomicrograph (magnification: 300,000) of this ribbon and the X-ray diffraction shown in FIG. 3(*a*), the resulting ribbon was almost completely amorphous.

Next, this amorphous ribbon was formed into a toroidal wound core of 15 mm in inner diameter and 19 mm in outer diameter, and then heat-treated in the same manner as in Example 1. FIG. 3(*b*) shows an X-ray diffraction pattern of the alloy after the heat treatment, which indicates peaks assigned to crystal phases. It is evident from a tranmission electron photomicrograph (magnification: 300,000) of the heat-treated ribbon that most of the alloy structure of the ribbon after the heat treatment consists of fine crystalline particles. The crystalline particles had an average particle size of about 100 Å. From the analysis of the X-ray diffraction pattern and the transmission electron photomicrograph, it can be presumed that these crystalline particles are α-Fe having Si, B, etc. dissolved therein.

Next, the Fe-base soft magnetic alloy ribbons before and after the heat treatment were measured with respect to core loss $W_{2/100k}$ at a wave height of magnetic flux density Bm=2 kG and a frequency of 100 kHz. As a result, the core loss was 4100 mW/cc before the heat treatment, while it was 240 mW/cc after the heat treatment. Effective permeability $\mu e$ was also measured at a frequency of 1 kHz and Hm of 5mOe. As a result, the former (before the heat treatment) was 480, while the latter (after the heat treatment) was 10100.

EXAMPLE 3

A melt having the composition (by atomic %) of 1% Cu, 16.5% Si, 6% B, 3% Nb and balance substantially Fe was formed into a ribbon of 5 mm in width and 18 μm in thickness by a single roll method. The X-ray diffraction of this ribbon showed a halo pattern to an amorphous alloy, meaning that the resulting ribbon was almost completely amorphous.

Next, this amorphous ribbon was formed into a toroidal wound core of 15 mm in inner diameter and 19 mm in outer diameter, and then heat-treated in a nitrogen gas atmosphere at 550° C. for one hour. The X-ray diffraction of the heat-treated ribbon showed peaks assigned to crystals composed of an Fe-solid solution having a bcc structure. It is evident from a transmission electron photomicrograph (magnification: 300,000) of the heat-treated ribbon that most of the alloy structure of the ribbon after the heat treatment consists of fine crystalline particles. It was observed that the crystalline particles had an average particle size of about 100 Å.

Next, the Fe-base soft magnetic alloy ribbons before and after the heat treatment were measured with respect to core loss $W_{2/100k}$ at a wave height of magnetic flux density Bm=2 kG and a frequency of 100 kHz. As a result, the core loss was 4000 mW/cc before the heat treatment, while it was 220 mW/cc after the heat treatment. Effective permeability $\mu e$ was also measured at a frequency of 1 kHz and Hm of 5 mOe. As a result, the former (before the heat treatment) was 500, while the latter (after the heat treatment) was 100200.

Next, the alloy of this Example containing both Cu and Nb was measured with respect to saturation magnetostriction λs. It was $+20.7\times10^{-6}$ in an amorphous state before heat treatment, but it was reduced to $+1.3\times10^{-6}$ by heat treatment at 550° C. for one hour, much smaller than the magnetostriction of conventional Fe-base amorphous alloys.

EXAMPLE 4

A melt having the composition (by atomic %) of 1% Cu, 13.8% Si, 8.9% B, 3.2% Nb, 0.5% Cr, 1% C and balance substantially Fe was formed into a ribbon of 10 mm in width and 18 μm in thickness by a single roll method. The X-ray diffraction of this ribbon showed a halo pattern peculiar to an amorphous alloy. The transmission electron photomicrograph (magnification: 300,000) of this ribbon showed that the resulting ribbon was almost completely amorphous.

Next, this amorphous ribbon was formed into a toroidal wound core of 15 mm in inner diameter and 19 mm in outer diameter, and then heat-treated in a nitrogen gas atmosphere at 570° C. for one hour. It is evident from a tranmission electron photomicrograph (magnification: 300,000) of the ribbon after the heat treatment that most of the alloy structure of the ribbon after the heat treatment consists of fine crystalline particles. The crystalline particles had an average particle size of about 100 Å.

Next, the Fe-base soft magnetic alloy ribbons before and after the heat treatment were measured with respect to core loss $W_{2/100k}$ at a wave height of magnetic flux density Bm=2 kG and a frequency of 100 kHz. As a result, the core loss was 3800 mW/cc before the heat treatment, while it was 240 mW/cc after the heat treatment. Effective permeability $\mu e$ was also measured at a frequency of 1 kHz and Hm of 5 mOe. As a result, the former (before the heat treatment) was 500, while the latter (after the heat treatment) was 102000.

EXAMPLE 5

Fe-base amorphous alloys having the compositions as shown in Table 1 were prepared under the same conditions as in Example 1. The resulting alloys were classified into 2 groups, and those in one group were subjected to the same heat treatment as in Example 1, and those in the other group were subjected to a conventional heat treatment (400° C. ×1 hour) to keep an amorphous state. They were then measured with respect to core loss $W_{2/100k}$ at 100 kHz and 2 kG and effective permeability μelk at 1 kHz and Hm=5 mOe. The results are shown in Table 1.

TABLE 1

| Sample No. | Alloy Composition (at %) | Heat Treatment of Present Invention: Core Loss $W_{2/100K}$ (mW/cc) | Heat Treatment of Present Invention: Effective Permeability μe1K | Conventional Heat Treatment: Core Loss $W_{2/100K}$ (mW/cc) | Conventional Heat Treatment: Effective Permeability μe1K |
|---|---|---|---|---|---|
| 1 | $Fe_{74}Cu_{0.5}Nb_3Si_{13.5}B_9$ | 240 | 71000 | 1300 | 8000 |
| 2 | $Fe_{73.5}Cu_1Nb_3Si_{13.5}B_9$ | 230 | 101000 | 1500 | 6800 |
| 3 | $Fe_{71.5}Cu_1Nb_5Si_{13.5}B_9$ | 220 | 98000 | 1800 | 7500 |
| 4 | $Fe_{71}Cu_{1.5}Nb_5Si_{13.5}B_9$ | 250 | 73000 | 1900 | 7300 |
| 5 | $Fe_{70}Cu_2Nb_7Si_{11}B_{10}$ | 300 | 62000 | 1800 | 7000 |
| 6 | $Fe_{69.5}Cu_{2.5}Nb_8Si_9B_{11}$ | 350 | 55000 | 1700 | 7200 |
| 7 | $Fe_{73.5}Cu_1Mo_3Si_{13.5}B_9$ | 250 | 40000 | 1100 | 7800 |
| 8 | $Fe_{71.5}Cu_1Mo_5Si_{13.5}B_9$ | 240 | 61000 | 1200 | 8200 |
| 9 | $Fe_{71.5}Cu_1W_5Si_{13.5}B_9$ | 280 | 71000 | 1300 | 8000 |
| 10 | $Fe_{76}Cu_1Ta_3Si_{12}B_8$ | 270 | 68000 | 1600 | 5800 |
| 11 | $Fe_{73.5}Cu_1Zr_3Si_{13.5}B_9$ | 280 | 42000 | 1900 | 5500 |
| 12 | $Fe_{73}Cu_1Hf_4Si_{14}B_8$ | 290 | 41000 | 1900 | 5600 |
| 13 | $(Fe_{0.95}Co_{0.05})_{72}Cu_1Nb_5Si_7B_{15}$ | 320 | 45000 | 1800 | 5600 |
| 14 | $(Fe_{0.9}Co_{0.1})_{72}Cu_1Nb_5Si_{12}B_{10}$ | 370 | 38000 | 1900 | 4700 |
| 15 | $(Fe_{0.95}Ni_{0.05})_{72}Cu_1Nb_5Si_{10}B_{12}$ | 300 | 46000 | 1800 | 5800 |

EXAMPLE 6

Fe-base amorphous alloys having the compositions as shown in Table 2 were prepared under the same conditions as in Example 1. The resulting alloys were classified into 2 groups, and those in one group were subjected to the same heat treatment as in Example 1, and those in the other group were subjected to a conventional heat treatment (400° C. ×1 hour) to keep an amorphous state. They were then measured with respect to core loss $W_{2/100k}$ at 100 kHz and 2 kG and effective permeability μelk at 1 kHz and Hm=5 mOe. The results are shown in Table 2.

EXAMPLE 7

Fe-base amorphous alloys having the compositions as shown in Table 3 were prepared under the same conditions as in Example 4. The resulting alloys were classified into 2 groups, and those in one group were subjected to the same heat treatment as in Example 4, and those in the other group were subjected to a conventional heat treatment (400° C. ×1 hour) to keep an amorphous state. They were then measured with respect to core loss $W_{2/100k}$ at 100 kHz and 2 kG and effective permeability μelk at 1 KHz and Hm=5 mOe. The results are shown in Table 3.

TABLE 2

| Sample No. | Alloy Composition (at %) | Heat Treatment of Present Invention: Core Loss $W_{2/100K}$ (mW/cc) | Heat Treatment of Present Invention: Effective Permeability μe1K | Conventional Heat Treatment: Core Loss $W_{2/100K}$ (mW/cc) | Conventional Heat Treatment: Effective Permeability μe1K |
|---|---|---|---|---|---|
| 1 | $Fe_{71}Cu_1Si_{15}B_9Nb_3Ti_1$ | 230 | 98000 | 1900 | 7800 |
| 2 | $Fe_{69}Cu_1Si_{15}B_9W_5V_1$ | 280 | 62000 | 2000 | 6800 |
| 3 | $Fe_{69}Cu_1Si_{16}B_8Mo_5Mn_1$ | 280 | 58000 | 1800 | 6700 |
| 4 | $Fe_{69}Cu_1Si_{17}B_7Nb_5Ru_1$ | 250 | 102000 | 1500 | 7200 |
| 5 | $Fe_{71}Cu_1Si_{14}B_{10}Ta_3Rh_1$ | 290 | 78000 | 1800 | 6900 |
| 6 | $Fe_{72}Cu_1Si_{14}B_9Zr_3Pd_1$ | 300 | 52000 | 2100 | 6500 |
| 7 | $Fe_{72.5}Cu_{0.5}Si_{14}B_9Hf_3Ir_1$ | 310 | 53000 | 2000 | 6600 |
| 8 | $Fe_{70}Cu_2Si_{16}B_8Nb_3Pt_1$ | 270 | 95000 | 1800 | 7800 |
| 9 | $Fe_{70.5}Cu_{1.5}Si_{15}B_9Nb_3Au_1$ | 250 | 111000 | 1700 | 7900 |
| 10 | $Fe_{71.5}Cu_{0.5}Si_{15}B_9Nb_3Zn_1$ | 300 | 88000 | 1900 | 8000 |
| 11 | $Fe_{69.5}Cu_{1.5}Si_{15}B_9Nb_3Mo_1Sn_1$ | 270 | 97000 | 1800 | 7800 |
| 12 | $Fe_{68.5}Cu_{2.5}Si_{15}B_9Nb_3Ta_1Re_1$ | 330 | 99000 | 2500 | 6900 |
| 13 | $Fe_{70}Cu_1Si_{15}B_9Nb_3Zr_1Al_1$ | 300 | 88000 | 2300 | 6500 |
| 14 | $Fe_{70}Cu_1Si_{15}B_9Nb_3Hf_1Sc_1$ | 280 | 86000 | 2400 | 6200 |
| 15 | $Fe_{70}Cu_1Si_{15}B_9HF_3Zr_1Y_1$ | 340 | 48000 | 2000 | 6300 |
| 16 | $Fe_{71}Cu_1Si_{15}B_9Nb_3La_1$ | 380 | 29000 | 2500 | 5800 |
| 17 | $Fe_{67}Cu_1Si_{17}B_9Mo_5Ce_1$ | 370 | 27000 | 2400 | 5700 |
| 18 | $Fe_{67}Cu_1Si_{17}B_9W_5Pr_1$ | 390 | 23000 | 2600 | 5500 |
| 19 | $Fe_{67}Cu_1Si_{17}B_9Ta_5Nd_1$ | 400 | 21000 | 2600 | 5300 |
| 20 | $Fe_{67}Cu_1Si_{17}B_9Zr_5Sm_1$ | 360 | 23000 | 2500 | 5200 |
| 21 | $Fe_{67}Cu_1Si_{16}B_{10}Hf_5Eu_1$ | 370 | 20000 | 2600 | 5300 |
| 22 | $Fe_{68}Cu_1Si_{18}B_9Nb_3Gd_1$ | 380 | 21000 | 2400 | 5400 |
| 23 | $Fe_{68}Cu_1Si_{19}B_8Nb_3Tb_1$ | 350 | 20000 | 2500 | 5300 |
| 24 | $Fe_{72}Cu_1Si_{14}B_9Nb_3Dv_1$ | 370 | 21000 | 2600 | 5200 |
| 25 | $Fe_{72}Cu_1Si_{14}B_9Nb_3Mo_1$ | 360 | 20000 | 2500 | 5300 |
| 26 | $Fe_{71}Cu_1Si_{14}B_9Nb_3Cr_1Ti_1$ | 250 | 88000 | 1900 | 7700 |
| 27 | $(Fe_{0.95}Co_{0.05})_{72}Cu_1Si_{14}B_9Nb_3Cr_1$ | 240 | 85000 | 1800 | 7800 |
| 28 | $(Fe_{0.95}Co_{0.05})_{72}Cu_1Si_{14}B_9Ta_3Ra_1$ | 260 | 80000 | 2200 | 6800 |
| 29 | $(Fe_{0.9}Co_{0.1})_{72}Cu_1Si_{14}B_9Ta_3Mn_1$ | 270 | 75000 | 2500 | 6200 |
| 30 | $(Fe_{0.99}Ni_{0.01})_{72}Cu_1Si_{14}B_9Ta_3Ru_1$ | 260 | 89000 | 1900 | 7800 |
| 31 | $(Fe_{0.95}Ni_{0.05})_{71}Cu_1Si_{14}B_9Ta_3Cr_1Ru_1$ | 270 | 85000 | 2000 | 6900 |
| 32 | $(Fe_{0.90}Ni_{0.10})_{68}Cu_1Si_{15}B_9W_5Ti_1Ru_1$ | 290 | 78000 | 2300 | 6500 |
| 33 | $(Fe_{0.95}Co_{0.03}Ni_{0.02})_{69.5}Cu_1Si_{13.5}B_9W_5Cr_1Rh_1$ | 270 | 75000 | 2100 | 6600 |
| 34 | $(Fe_{0.98}Co_{0.01}Ni_{0.01})_{67}Cu_1Si_{15}B_9W_5Ru_3$ | 250 | 72000 | 1800 | 7500 |

Thus, it has been clarified that the heat treatment according to the present invention can provide the alloy with low core loss and high effective permeability.

TABLE 3

| Sample No. | Alloy Composition (at %) | Heat Treatment of Present Invention: Core Loss $W_{2/100K}$ (mW/cc) | Heat Treatment of Present Invention: Effective Permeability $\mu e$ (1 kHz) | Conventional Heat Treatment: Core Loss $W_{2/100K}$ (mW/cc) | Conventional Heat Treatment: Effective Permeability $\mu e$ (1 kHz) |
|---|---|---|---|---|---|
| 1 | $Fe_{73}Cu_1Si_{13}B_9Nb_3C_1$ | 240 | 70000 | 1400 | 7000 |
| 2 | $Fe_{73}Cu_1Si_{13}B_9Nb_3Ge_1$ | 230 | 68000 | 1400 | 7100 |
| 3 | $Fe_{73}Cu_1Si_{13}B_9Nb_3P_1$ | 250 | 65000 | 1500 | 6800 |
| 4 | $Fe_{73}Cu_1Si_{13}B_9Nb_3Ga_1$ | 250 | 66000 | 1300 | 7200 |
| 5 | $Fe_{73}Cu_1Si_{13}B_9Nb_3Sb_1$ | 300 | 59000 | 1700 | 6600 |
| 6 | $Fe_{73}Cu_1Si_{13}B_9Nb_3As_1$ | 310 | 63000 | 1900 | 5900 |
| 7 | $Fe_{71}Cu_1Si_{13}B_8Mo_5C_2$ | 320 | 52000 | 1700 | 6500 |
| 8 | $Fe_{70}Cu_1Si_{14}B_6Mo_3Cr_1C_5$ | 330 | 48000 | 1900 | 5700 |
| 9 | $(Fe_{0.95}Co_{0.05})_{70}Cu_1Si_{13}B_9Nb_5Al_1C_1$ | 350 | 38000 | 1800 | 5800 |
| 10 | $(Fe_{0.98}Ni_{0.02})_{70}Cu_1Si_{13}B_9W_5V_1Ge_1$ | 340 | 39000 | 1700 | 5900 |
| 11 | $Fe_{68.5}Cu_{1.5}Si_{13}B_9Nb_5Ru_1C_2$ | 250 | 88000 | 1900 | 6800 |
| 12 | $Fe_{70}Cu_1Si_{14}B_8Ta_3Cr_1Ru_2C_1$ | 290 | 66000 | 1800 | 6700 |
| 13 | $Fe_{70}Cu_1Si_{14}B_9Mb_5Be_1$ | 250 | 66000 | 1900 | 6800 |
| 14 | $Fe_{68}Cu_1Si_{15}B_9Nb_5Mn_1Be_1$ | 250 | 91000 | 1700 | 6900 |
| 15 | $Fe_{69}Cu_2Si_{14}B_8Zr_5Rh_1In_1$ | 280 | 68000 | 1800 | 6800 |
| 16 | $Fe_{71}Cu_2Si_{13}B_7Hf_5Au_1C_1$ | 290 | 59000 | 2000 | 5800 |
| 17 | $Fe_{66}Cu_1Si_{16}B_{10}Mo_5Sc_1Ge_1$ | 280 | 65000 | 1900 | 6800 |
| 18 | $Fe_{67.5}Cu_{0.5}Si_{14}B_{11}Nb_5Y_1P_1$ | 250 | 77000 | 1800 | 5900 |
| 19 | $Fe_{67}Cu_1Si_{13}B_{12}Nb_5La_1Ga_1$ | 400 | 61000 | 2100 | 6100 |
| 20 | $(Fe_{0.95}Ni_{0.05})_{70}Cu_1Si_{13}B_9Nb_5Sm_1Sb_1$ | 410 | 58000 | 2200 | 6800 |
| 21 | $(Fe_{0.92}Co_{0.08})_{70}Cu_1Si_{13}B_9Nb_5Zn_1As_1$ | 380 | 57000 | 2000 | 6700 |
| 22 | $(Fe_{0.96}Ni_{0.02}Co_{0.02})_{70}Cu_1Si_{13}B_9Nb_5Sn_1In_1$ | 390 | 58000 | 1900 | 5600 |
| 23 | $Fe_{69}Cu_1Si_{13}B_9Mo_5Re_1C_2$ | 330 | 55000 | 1800 | 5700 |
| 24 | $Fe_{69}Cu_1Si_{13}B_9Mo_5Ce_1C_2$ | 400 | 56000 | 1900 | 5600 |
| 25 | $Fe_{69}Cu_1Si_{13}B_9W_5Pr_1C_2$ | 410 | 52000 | 1800 | 5700 |
| 26 | $Fe_{69}Cu_1Si_{13}B_9W_5Nd_1C_2$ | 390 | 50000 | 1900 | 5800 |
| 27 | $Fe_{68}Cu_1Si_{14}B_9Ta_5Gd_1C_2$ | 410 | 48000 | 2000 | 6000 |
| 28 | $Fe_{69}Cu_1Si_{13}B_9Nb_5Tb_1C_2$ | 420 | 50000 | 1800 | 5800 |
| 29 | $Fe_{70}Cu_1Si_{14}B_8Nb_5Dy_1Ge_1$ | 410 | 47000 | 1900 | 5600 |
| 30 | $Fe_{72}Cu_1Si_{13}B_7Nb_5Pd_1Ge_1$ | 400 | 46000 | 2000 | 6100 |
| 31 | $Fe_{70}Cu_1Si_{13}B_9Nb_5Ir_1P_1$ | 410 | 57000 | 2100 | 6200 |
| 32 | $Fe_{70}Cu_1Si_{13}B_9Nb_5Os_1Ga_1$ | 250 | 71000 | 1900 | 5800 |
| 33 | $Fe_{71}Cu_1Si_{14}B_9Ta_3Cr_1C_1$ | 280 | 61000 | 1800 | 6000 |
| 34 | $Fe_{67}Cu_1Si_{16}B_6Zr_5V_1C_5$ | 290 | 58000 | 2100 | 5300 |
| 35 | $Fe_{63}Cu_1Si_{16}B_5Hf_5Cr_2C_8$ | 280 | 57000 | 2200 | 5200 |
| 36 | $Fe_{68}Cu_1Si_{14}B_9Mo_4Ru_3C_1$ | 260 | 51000 | 1900 | 5600 |
| 37 | $Fe_{70}Cu_1Si_{14}B_9Mo_3Ti_1Ru_1C_1$ | 270 | 48000 | 2000 | 5700 |
| 38 | $Fe_{67}Cu_1Si_{14}B_9Nb_6Rh_2C_1$ | 240 | 72000 | 1800 | 6000 |

EXAMPLE 8

Thin amorphous alloy ribbons of 5 mm in width and 18 μm in thickness and having the compositions as shown in Table 4 were prepared by a single roll method, and each of the ribbons was wound into a toroid of 19 mm in outer diameter and 15 mm in inner diameter, and then heat-treated at temperatures higher than the crystallization temperature. They were then measured with respect to DC magnetic properties, effective permeability μelk at 1 kHz and core loss $W_{2/100k}$ at 100 kHz and 2 kG. Saturation magnetization λs was also measured. The results are shown in Table 4.

TABLE 4

| Sample No. | Composition (at %) | Bs (KG) | Hc (Oe) | μe1k | $W_{2/100K}$ (mW/CC) | λs ($\times 10^{-6}$) |
|---|---|---|---|---|---|---|
| 1 | $Fe_{74}Cu_{0.5}Si_{13.5}B_9Nb_3$ | 12.4 | 0.013 | 68000 | 300 | +1.8 |
| 2 | $Fe_{74}Cu_{1.5}Si_{13.5}B_9Nb_2$ | 12.6 | 0.015 | 76000 | 230 | +2.0 |
| 3 | $Fe_{79}Cu_{1.0}Si_8B_9Nb_3$ | 14.6 | 0.056 | 21000 | 470 | +1.8 |
| 4 | $Fe_{74.5}Cu_{1.0}Si_{13.5}B_6Nb_5$ | 11.6 | 0.020 | 42000 | 350 | +1.5 |
| 5 | $Fe_{77}Cu_{1.0}Si_{10}B_9Nb_3$ | 14.3 | 0.025 | 48000 | 430 | +1.6 |
| 6 | $Fe_{73.5}Cu_{1.0}Si_{17.5}B_5Ta_3$ | 10.5 | 0.015 | 42000 | 380 | −0.3 |
| 7 | $Fe_{71}Cu_{1.5}Si_{13.5}B_9Mo_5$ | 11.2 | 0.012 | 68000 | 280 | +1.9 |
| 8 | $Fe_{74}Cu_{1.0}Si_{14}B_8W_3$ | 12.1 | 0.022 | 74000 | 250 | +1.7 |
| 9 | $Fe_{73}Cu_{2.0}Si_{13.5}B_{8.5}Hf_3$ | 11.6 | 0.028 | 29000 | 350 | +2.0 |
| 10 | $Fe_{74.5}Cu_{1.0}Si_{13.5}B_9Ta_2$ | 12.8 | 0.018 | 33000 | 480 | +1.8 |
| 11 | $Fe_{72}Cu_{1.0}Si_{14}B_8Zr_5$ | 11.7 | 0.030 | 28000 | 380 | +2.0 |
| 12 | $Fe_{71.5}Cu_{1.0}Si_{13.5}B_9Ti_5$ | 11.3 | 0.038 | 28000 | 480 | +1.8 |
| 13 | $Fe_{73}Cu_{1.5}Si_{13.5}B_9Mo_3$ | 12.1 | 0.014 | 69000 | 250 | +2.8 |
| 14 | $Fe_{73.5}Cu_{1.0}Si_{13.5}B_9Ta_3$ | 11.4 | 0.017 | 43000 | 330 | +1.9 |
| 15 | $Fe_{71}Cu_{1.0}Si_{13}B_{10}W_5$ | 10.0 | 0.023 | 68000 | 320 | +2.5 |
| 16 | $Fe_{78}Si_9B_{13}$ Amorphous | 15.6 | 0.03 | 5000 | 3300 | +2.7 |
| 17 | $Co_{70.3}Fe_{4.7}Si_{15}B_{10}$ Amorphous | 8.0 | 0.006 | 8500 | 350 | ~0 |
| 18 | $Fe_{84.2}Si_{9.6}Al_{6.2}$ (Wt %) | 11.0 | 0.02 | 10000 | — | ~0 |

Note: Nos. 16–18 Conventional alloys

EXAMPLE 9

Each of amorphous alloys having the composition of $Fe_{74.5-x}Cu_xNb_3Si_{13.5}B_9$ ($0 \leqq x \leqq 3.5$) was heat-treated at the following optimum heat treatment temperature for one hour, and then measured with respect to core loss $W_{2/100k}$ at a wave height of magnetic flux density Bm=2 kG and a frequency f=100 Hz.

| X [atomic %] | Heat Treatment Temperature (°C.) |
|---|---|
| 0 | 500 |
| 0.05 | 500 |
| 0.1 | 520 |
| 0.5 | 540 |
| 1.0 | 550 |
| 1.5 | 550 |
| 2.0 | 540 |
| 2.5 | 530 |
| 3.0 | 500 |
| 3.2 | 500 |
| 3.5 | 490 |

Figure 4:
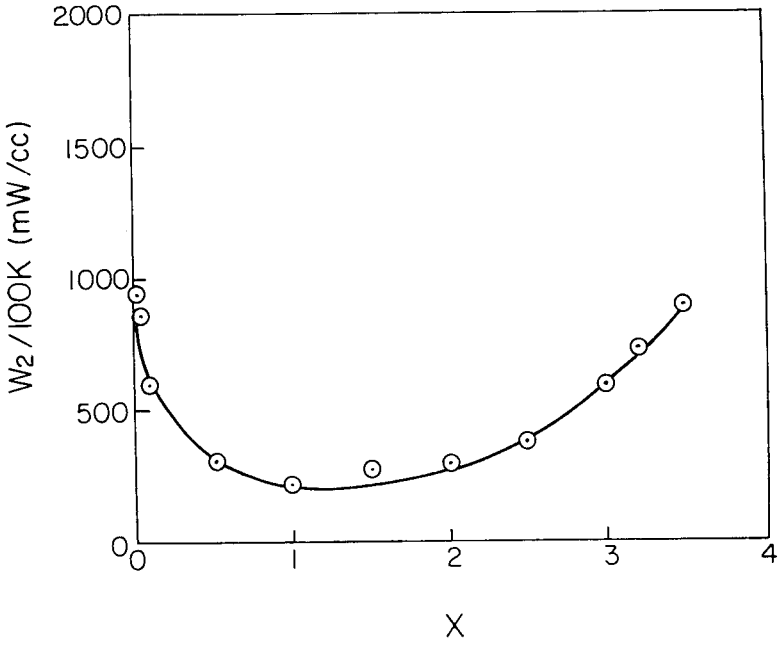
FIG. 4 is a graph showing the relations between Cu content (x) and core loss $W_{2/100k}$ with respect to the Fe-base soft magnetic alloy of Example 9.

The relations between the content of x of Cu (atomic %) and the core loss $W_{2/100k}$ are shown in FIG. 4. It is clear from FIG. 4 that the core loss decreases as the Cu content x increases from 0, but that when it exceeds about 3 atomic %, the core loss becomes as large as that of alloys containing no Cu. When x is in the range of 0.1–3 atomic %, the core loss is sufficiently small. Particularly desirable range of x appears to be 0.5–2 atomic %.

EXAMPLE 10

Each of amorphous alloys having the composition of $Fe_{73-x}Cu_xSi_{14}B_9Nb_3Cr_1$ ($0 \leqq x \leqq 3.5$) was heat-treated at the following optimum heat treatment temperature for one hour, and then measured with respect to core loss $W_{2/100k}$ k at a wave height of magnetic flux density Bm=2 kG and a frequency f=100 kHz.

| X (atomic %) | Heat Treatment Temperature (°C.) | Core Loss W2/100k (mW/cc) |
|---|---|---|
| 0 | 505 | 980 |
| 0.05 | 510 | 900 |
| 0.1 | 520 | 610 |
| 0.5 | 545 | 260 |
| 1.0 | 560 | 210 |
| 1.5 | 560 | 230 |
| 2.0 | 550 | 250 |
| 2.5 | 530 | 390 |
| 3.0 | 500 | 630 |
| 3.2 | 500 | 850 |
| 3.5 | 490 | 1040 |

It is clear from the above that the core loss decreases as the Cu content x increases from 0, but that when it exceeds about 3 atomic %, the core loss becomes as large as that of alloys containing no Cu. When x is in the range of 0.1–3 atomic %, the core loss is sufficiently small. Particularly desirable range of x appears to be 0.5–2 atomic %.

EXAMPLE 11

Each of amorphous alloys having the composition of $Fe_{69-x}Cu_xSi_{13.5}B_{9.5}Nb_5Cr_1C_2$ ($0 \leqq x \leqq 3.5$) was heat-treated at the following optimum heat treatment temperature for one hour, and then measured with respect to core loss $W_{2/100k}$ at a wave height of magnetic flux density Bm=2 kG and a frequency f=100 kHz.

| X (atomic %) | Heat Treatment Temperature (°C.) | Core Loss W2/100k (mW/cc) |
|---|---|---|
| 0 | 530 | 960 |
| 0.05 | 530 | 880 |
| 0.1 | 535 | 560 |
| 0.5 | 550 | 350 |
| 1.0 | 590 | 240 |
| 1.5 | 580 | 240 |
| 2.0 | 570 | 290 |
| 2.5 | 560 | 440 |
| 3.0 | 550 | 630 |
| 3.2 | 540 | 860 |
| 3.5 | 530 | 1000 |

It is clear from the above that the core loss decreases as the Cu content x increases from 0, but that when it exceeds about 3 atomic %, the core loss becomes as large as that of alloys containing no Cu. When x is in the range of 0.1–3 atomic %, the core loss is sufficiently small. Particularly desirable range of x appears to be 0.5–2 atomic %.

EXAMPLE 12

Each of amorphous alloys, having the composition of $Fe_{76.5-\alpha}Cu_1Si_{13}B_{9.5}M'_\alpha$ (M'=Nb, W, Ta or Mo) was heat-treated at the following optimum heat treatment temperature for one hour, and then measured with respect to core loss $W_{2/100k}$.

| α [atomic %] | Heat Treatment Temperature (°C.) |
|---|---|
| 0 | 400 |
| 0.1 | 405 |
| 0.2 | 410 |
| 1.0 | 430 |
| 2.0 | 480 |
| 3.0 | 550 |
| 5.0 | 580 |
| 7.0 | 590 |
| 8.0 | 590 |
| 10.0 | 590 |
| 11.0 | 590 |

Figure 5:
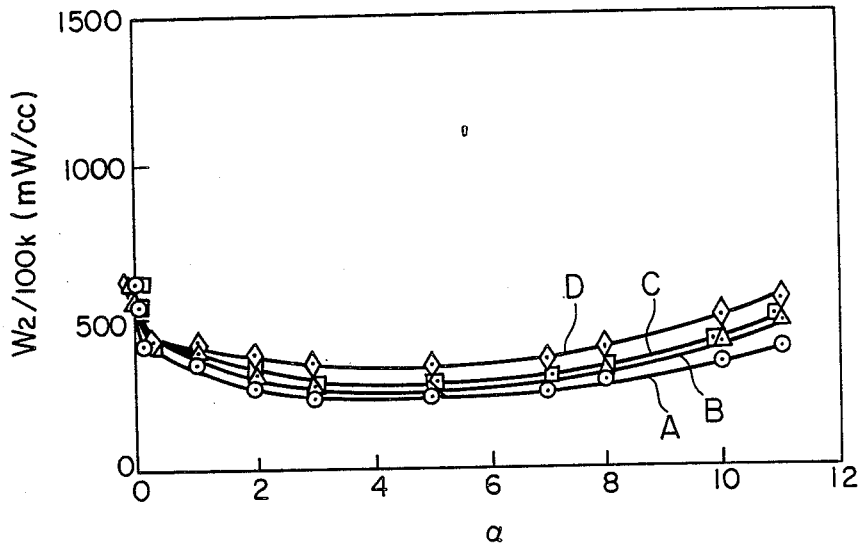
FIG. 5 is a graph showing the relations between M' content ($\alpha$) and core loss $W_{2/100k}$ with respect to the Fe-base soft magnetic alloy of Example 12.

The results are shown in FIG. 5, in which graphs A, B, C and D show the cases where M is Nb, W, Ta and Mo, respectively.

As is clear from FIG. 5, the core loss is sufficiently small when the amount α of M' is in the range of 0.1–10 atomic %. And particularly when M' is Nb, the core loss was extremely low. A particularly desired range of α is $2 \leqq \alpha \leqq 8$.

EXAMPLE 13

Each of amorphous alloys having the composition of $Fe_{75.5-\alpha}Cu_1Si_{13}B_{9.5}M'_\alpha Ti_1$ (M'=Nb, W, Ta, or Mo) was heat-treated at the following optimum heat treatment temperature for one hour, and then measured with respect to core loss $W_{2/100k}$.

| α [atomic %] | Heat Treatment Temperature (°C.) |
|---|---|
| 0 | 405 |
| 0.1 | 410 |
| 0.2 | 420 |
| 1.0 | 440 |
| 2.0 | 490 |
| 3.0 | 560 |
| 5.0 | 590 |
| 7.0 | 600 |
| 8.0 | 600 |

-continued

| α [atomic %] | Heat Treatment Temperature (°C.) |
|---|---|
| 10.0 | 600 |
| 11.0 | 600 |

Figure 6:
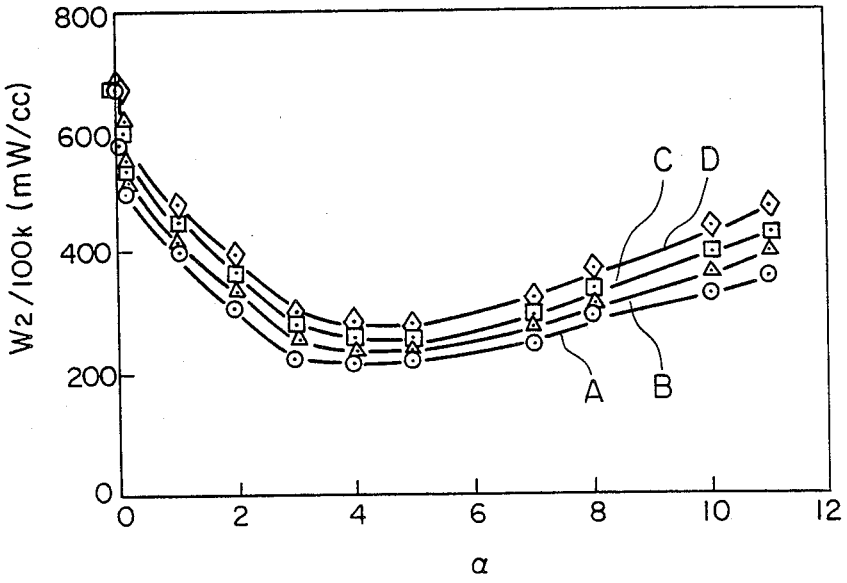
FIG. 6 is a graph showing the relations between M' content ($\alpha$) and core loss $W_{2/100k}$ with respect to the Fe-base soft magnetic alloy of Example 13.

The results are shown in FIG. 6, in which the graphs A, B, C and D show the cases where M' is Nb, W, Ta, and Mo, respectively.

As is clear from FIG. 6, the core loss is sufficiently small when the amount α of M' is in the range of 0.1–10 atomic %. And particularly when M' is Nb, the core loss was extremely low. A particularly desired range of α is $2 \leqq \alpha \leqq 8$.

EXAMPLE 14

Each of amorphous alloys having the composition of $Fe_{75-\alpha}Cu_1Si_{13}B_9Nb_\alpha Ru_1Ge_1$ was heat-treated at the following optimum heat treatment temperature for one hour, and then measured with respect to core loss $W_{2/100k}$.

| α [atomic %] | Heat Treatment Temperature (°C.) |
|---|---|
| 0 | 405 |
| 0.1 | 410 |
| 0.2 | 415 |
| 1.0 | 430 |
| 2.0 | 485 |
| 3.0 | 555 |
| 5.0 | 585 |
| 7.0 | 595 |
| 8.0 | 595 |
| 10.0 | 595 |
| 11.0 | 595 |

Figure 7:
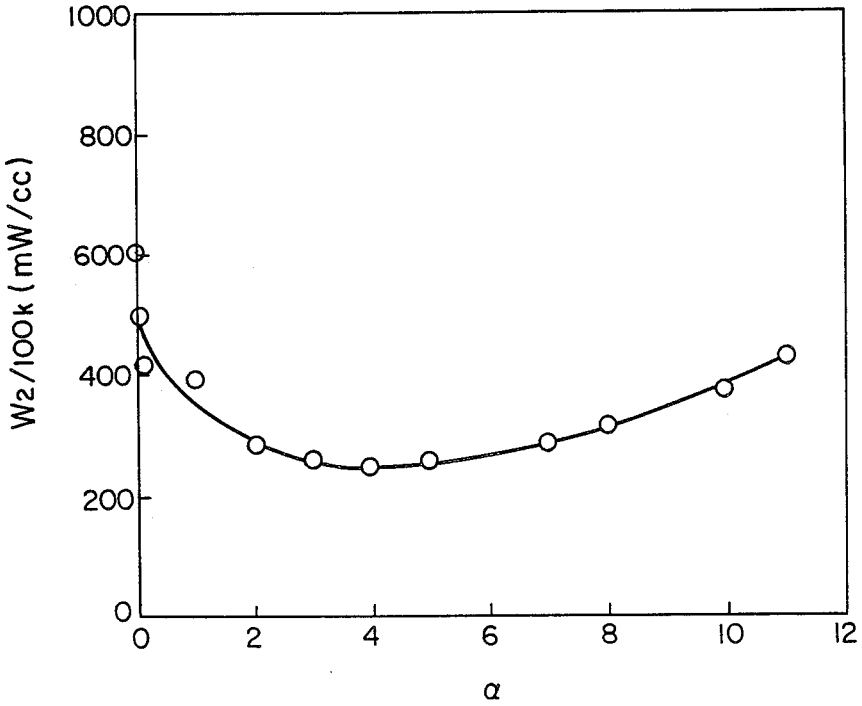
FIG. 7 is a graph showing the relations between Nb content ($\alpha$) and core loss $W_{2/100k}$ with respect to the Fe-base soft magnetic alloy of Example 14.

The results are shown in FIG. 7. As is clear from FIG. 7, the core loss is sufficiently small when the amount α of Nb is in the range of 0.1–10 atomic %. A particularly desired range of α is $2 \leqq \alpha \leqq 8$.

Incidentally, the electron microscopy showed that fine crystalline particles were generated when α was 0.1 or more.

EXAMPLE 15

Each of amorphous alloys having the composition of $Fe_{73.5}Cu_1Nb_3Si_{13}B_{9.5}$ was heat-treated at 550° C. for one hour. Their transmission electron microscopy revealed that each of them contained 50% or more of a crystal phase. They were measured with respect to effective permeablility μe at frequency of $1-1\times10^4$ KHz. Similiarly, a Co-base amorphous alloy ($Co_{69.6}Fe_{0.4}Mn_6Si_{15}B_9$) and Mn-Zn ferrite were measured with respect to effective permeability μe. The results are shown in FIG. 8, in which the graphs A, B and C show the heat-treated Fe-base soft magnetic alloy of the present invention, the Co-base amorphous alloy and the ferrite, respectively.

Figure 8:
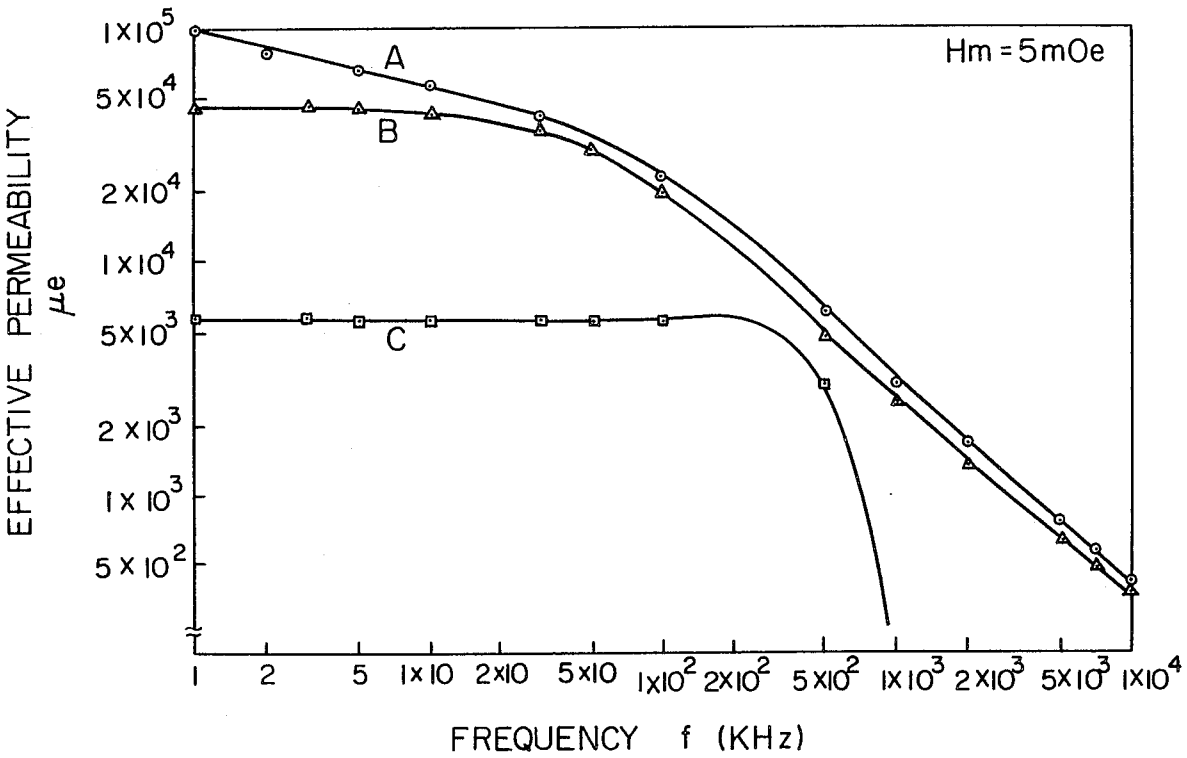
FIG. 8 is a graph showing the relations between frequency and effective permeability with respect to the Fe-base soft magnetic alloy of Example 15, the Co-base amorphous alloy and ferrite.

FIG. 8 shows that the Fe-base soft magnetic alloy of the present invention has permeability equal to or higher than that of the Co-base amorphous alloy and extremely higher than that of the ferrite in a wide frequency range. Because of this, the Fe-base soft magnetic alloy of the greatest invention is suitable for choke coils, magnetic heads, shielding materials, various sensor materials, etc.

EXAMPLE 16

Each of amorphous alloys having the composition of $Fe_{72}Cu_1Si_{13.5}B_{9.5}Nb_3Ru_1$ was heat-treated at 550° C. for one hour. Their transmission electron microscopy revealed that each of them contained 50% or more of a crystal phase. They were measured with respect to effective permeability μe at a frequency of $1-1\times10^4$ KHz. Similarly a Co-base amorphous alloy ($CO_{69.6}Fe_{0.4}Mn_6Si_{15}B_9$) and Mn-Zn ferrite were measured with respect to effective permeability μe. The results are shown in FIG. 9, in which graphs A, B and C show the heat-treated Fe-base soft magnetic alloy of the present invention, the Co-base amorphous alloy and the ferrite, respectively.

Figure 9:
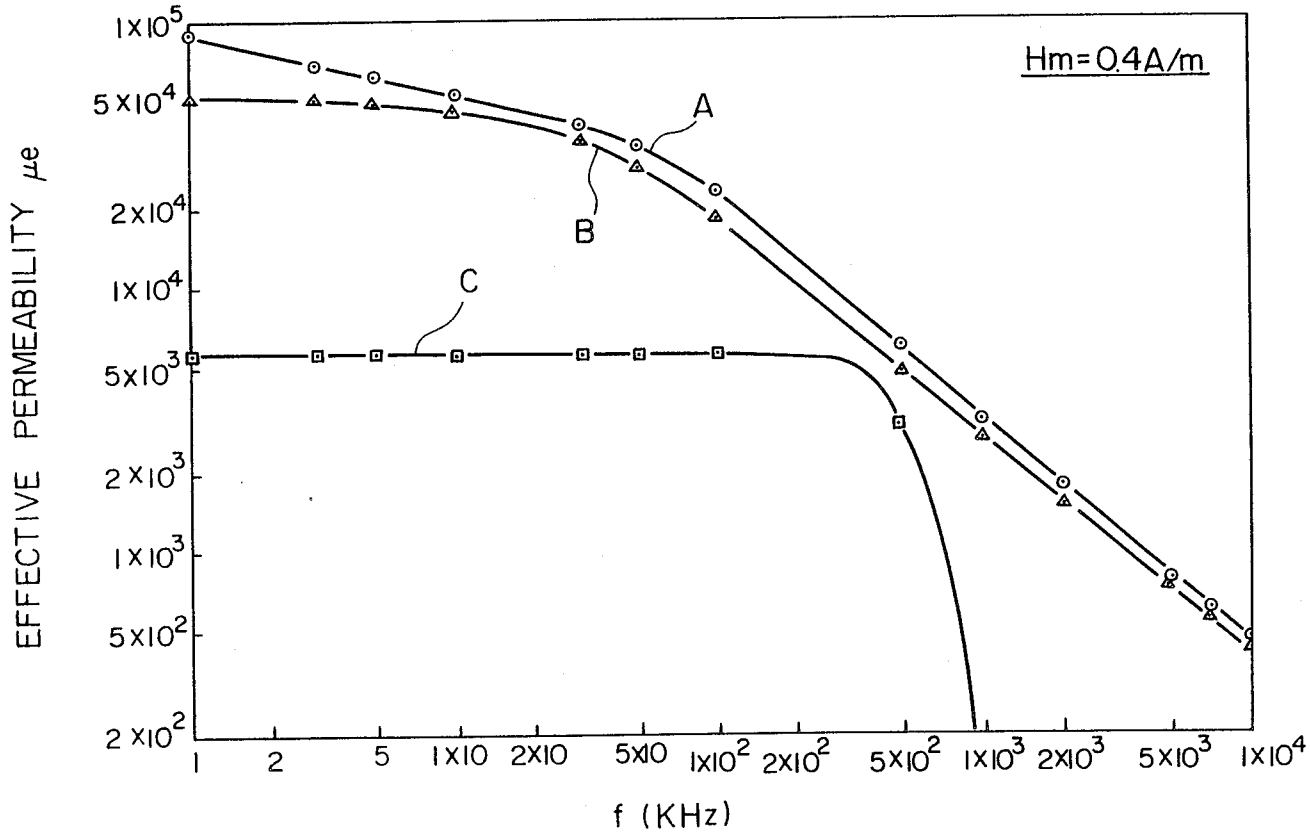
FIG. 9 is a graph showing the relations between frequency and effective permeability with respect to the Fe-base soft magnetic alloy of Example 16, Co-base amorphous alloy and ferrite.

FIG. 9 shows that the Fe-base soft magnetic alloy of the present invention has permeability equal to or higher than that of the Co-base amorphous alloy and extremely higher than that of the ferrite in a wide frequency range.

EXAMPLE 17

Each of amorphous alloys having the composition of $Fe_{71}Cu_1Si_{15}B_8Nb_3Zr_1P_1$ was heat-treated at 550° C. for one hour. Their transmission electron microscopy revealed that each of them contained 50% or more of a crystal phase and then measured with respect to effective permeability μe at frequency of $1-1\times10^4$ KHz. Similarly a Co-base amorphous alloy ($Co_{66}Fe_4Ni_3Mo_2Si_{15}B_{10}$), an Fe-base amorphous alloy ($Fe_{77}Cr_1Si_{13}B_9$), and Mn-Zn ferrite were measured with respect to effective permeability μe. The results are shown in FIG. 10, in which graphs A, B, C and D show the heat-treated Fe-base soft magnetic alloy of the present invention, the Co-base amorphous alloy, the Fe-base amorphous alloy and the ferrite, respectively.

Figure 10:
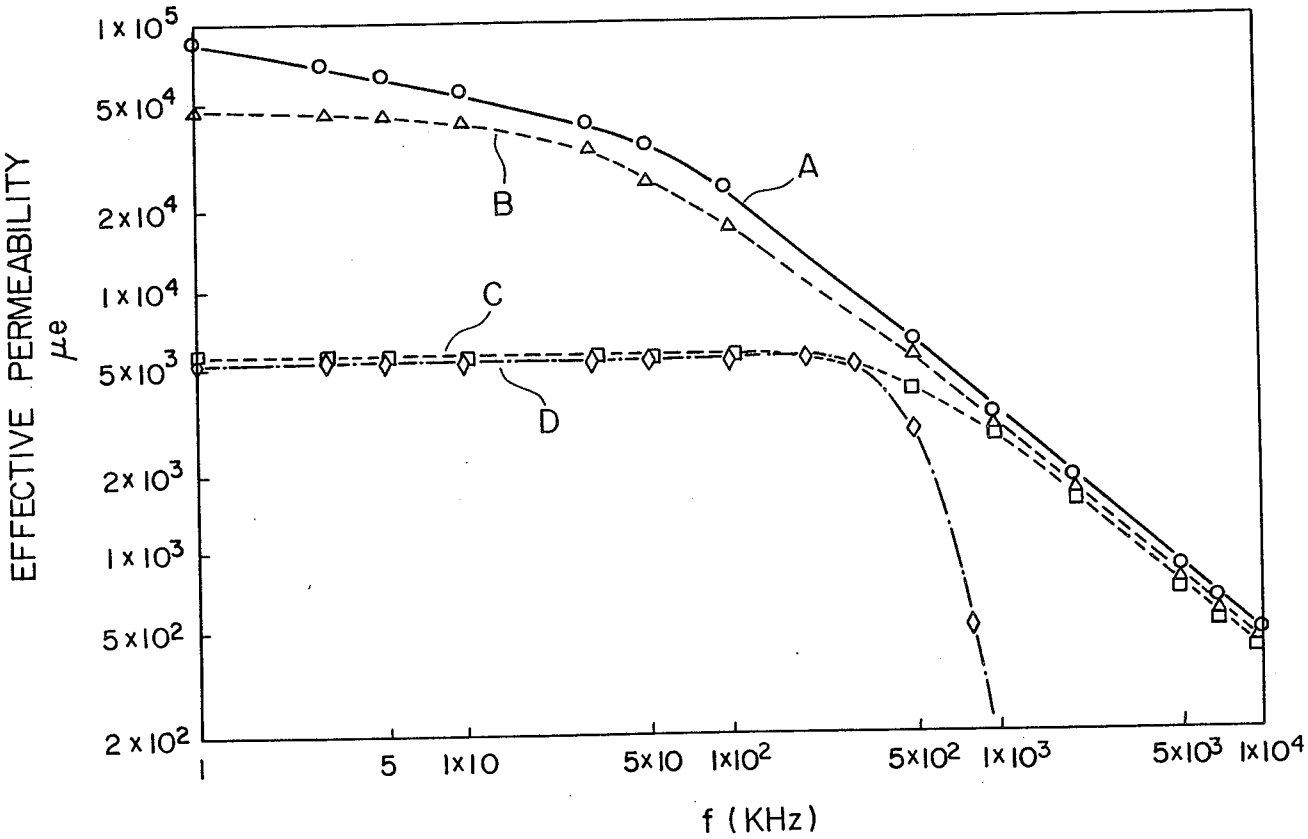
FIG. 10 is a graph showing the relations between frequency and effective permeability with respect to the Fe-base soft magnetic alloy of Example 17, Co-base amorphous alloy, Fe-base amorphous alloy and ferrite.

FIG. 10 shows that the Fe-base soft magnetic alloy of the present invention has permeability equal to or higher than that of the Co-base amorphous alloy and extremely higher than that of the Fe-base amorphous alloy and the ferrite in a wide frequency range.

EXAMPLE 18

Amorphous alloys having the compositions as shown in Table 5 were prepared under the same conditions as in Example 1, and on each alloy the relations between heat treatment conditions and the time variability of core loss were investigated. One heat treatment condition was 550° C. for one hour (according to the present invention), and the other was 400° C.×1 hour (conventional method). It was confirmed by electron microscopy that the Fe-base soft magnetic alloy heat-treated at 550° C. for one hour according to the present invention contained 50% or more of fine crystal phase. Incidentally, the time variation of core loss $(W_{100}-W_0)/W_0$ was calculated from core loss ($W_0$) measured immediately after the heat treatment of the present invention and core loss ($W_{100}$) measured 100 hours after keeping at 150° C., both at 2 kG and 100 kHz. The results are shown in Table 5.

TABLE 5

| No. | Alloy Composition (atomic %) | Time Variation of Core Loss $(W_{100}-W_0)/W_0$ Heat Treatment of Present Invention | Conventional Heat Treatment |
|---|---|---|---|
| 1 | $Fe_{71}Cu_1Nb_3Si_{10}B_{15}$ | 0.0005 | 0.05 |
| 2 | $Fe_{70.5}Cu_{1.5}Nb_5Si_{11}B_{12}$ | 0.0003 | 0.04 |
| 3 | $Fe_{70.5}Cu_{1.5}Mo_5Si_{13}B_{10}$ | 0.0004 | 0.05 |
| 4 | $Co_{69}Fe_4Nb_2Si_{15}B_{10}$ | — | 1.22 |
| 5 | $Co_{69.5}Fe_{4.5}Mo_2Si_{15}B_9$ | — | 1.30 |

The above results show that the heat treatment of the present invention reduces the time variation of core loss (Nos. 1–3). Also it is shown that as compared with the conventional, low-core loss Co-base amorphous alloys (Nos. 4 and 5), the Fe-base soft magnetic alloy of the present invention has extremely reduced time variation of core loss. Therefore, the Fe-base soft magnetic alloy of the present invention can be used for highly reliable magnetic parts.

EXAMPLE 19

Amorphous alloys having the composition as shown in Table 6 were prepared under the same conditions as in Example 1, and on each alloy the relations between heat treatment conditions and Curie temperature (Tc) were investigated. One heat treatment condition was 550° C. × 1 hour (present invention), and the other heat treatment condition was 350° C. × 1 hour (conventional method). In the present invention, the Curie temperature was determined from a main phase (fine crystalline particles) occupying most of the alloy structure. It was confirmed by X-ray diffraction that those subjected to heat treatment at 350° C. for 1 hour showed a halo pattern peculiar to amorphous alloys, meaning that they were substantially amorphous. On the other hand, those subjected to heat treatment at 550° C. for 1 hour showed peaks assigned to crystal phases, showing substantially no halo pattern. Thus, it was confirm that they were substantially composed of crystalline phases. The Curie temperature (Tc) measured in each heat treatment is shown in Table 6.

TABLE 6

| No. | Alloy Composition (atomic %) | Curie Temperature (°C.) Heat Treatment of Present Invention | Conventional Heat Treatment |
|---|---|---|---|
| 1 | $Fe_{73.5}Cu_1Nb_3Si_{13.5}B_9$ | 567 | 340 |
| 2 | $Fe_{71}Cu_{1.5}Nb_5Si_{13.5}B_9$ | 560 | 290 |
| 3 | $Fe_{71.5}Cu_1Mo_5Si_{13.5}B_9$ | 560 | 288 |
| 4 | $Fe_{74}Cu_1Ta_3Si_{12}B_{10}$ | 565 | 334 |
| 5 | $Fe_{71.5}Cu_1W_5Si_{13.5}B_9$ | 561 | 310 |

The above results show that the heat treatment of the present invention extremely enhances the Curie temperature (Tc). Thus, the alloy of the present invention has magnetic properties less variable with the temperature change than the amorphous alloys. Such a large difference in Curie temperature between the Fe-base soft magnetic alloy of the present invention and the amorphous alloys is due to the fact that the alloy subjected to the heat treatment of the present invention is finely crystallized.

EXAMPLE 20

A ribbon of an amorphous alloy having the composition of $Fe_{74.5-x}Cu_xNb_3Si_{13.5}B_9$ (width: 5 mm and thickness: 18μm) was formed into a toroidal wound core of 15 mm in inner diameter and 19 mm in outer diameter and heat-treated at various temperatures for one hour. Core loss $W_{2/100k}$ at 2 kG and 100 kHz was measured on each of them. The results are shown in FIG. 11.

The crystallization temperatures (Tx) of the amorphous alloys used for the wound cores were measured by a differential scanning calorimeter (DSC). The crystallization temperature Tx measured at a temperature-elevating speed of 10 ° C./minute on each alloy were 583° C. for x=0 and 507° C. for x=0.5, 1.0 and 1.5.

Figure 11:
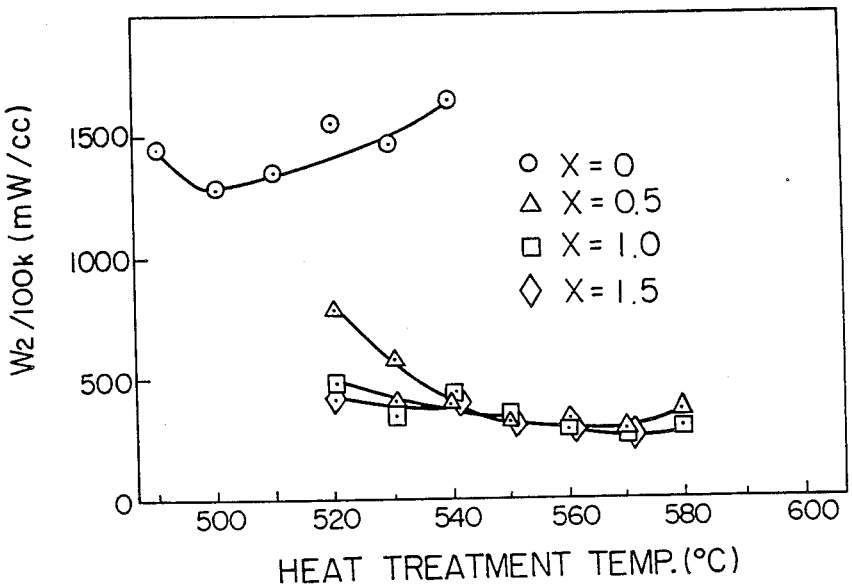
FIG. 11 is a graph showing the relations between heat treatment temperature and core loss with respect to the Fe-base soft magnetic alloy of Example 20.

As is clear from FIG. 11, when the Cu content x is 0, core loss $W_{2/100k}$ is extremely large, and as the Cu content increases up to about 1.5 atomic %, the core loss becomes small and also a proper heat treatment temperature range becomes as high as 540°–580° C., exceeding that of those containing no Cu. This temperature is higher than the crystallization temperature Tx measured at a temperature-elevating speed of 10° C./minute by DSC. Incidentally, it was confirmed by transmission electron microscopy that the Fe-base soft magnetic alloy of the present invention containing Cu was constituted by 50% or more of fine crystalline particles.

EXAMPLE 21

A ribbon of an amorphous alloy having the composition of $Fe_{73-x}Cu_xSi_{13}B9Nb_3Cr_1C_1$ (width: 5 mm and thickness: 18 μm) was formed into a toroidal wound core of 15 mm in inner diameter and 19 mm in outer diameter and heat-treated at various temperatures for one hour. Core loss $W_{2/100k}$ at 2kG and 100 kHz was measured on each of them. The results are shown in FIG. 12.

The crystallization temperatures (Tx) of the amorphous alloys used for the wound cores were measured by a differential scanning calorimeter (DSC). The crystallization temperatures Tx measured at a temperature-elevating speed of 10 ° C./minute on each alloy were 580° C. for x=0 and 505° C. for x=0.5, 1.0 and 1.5.

Figure 12:
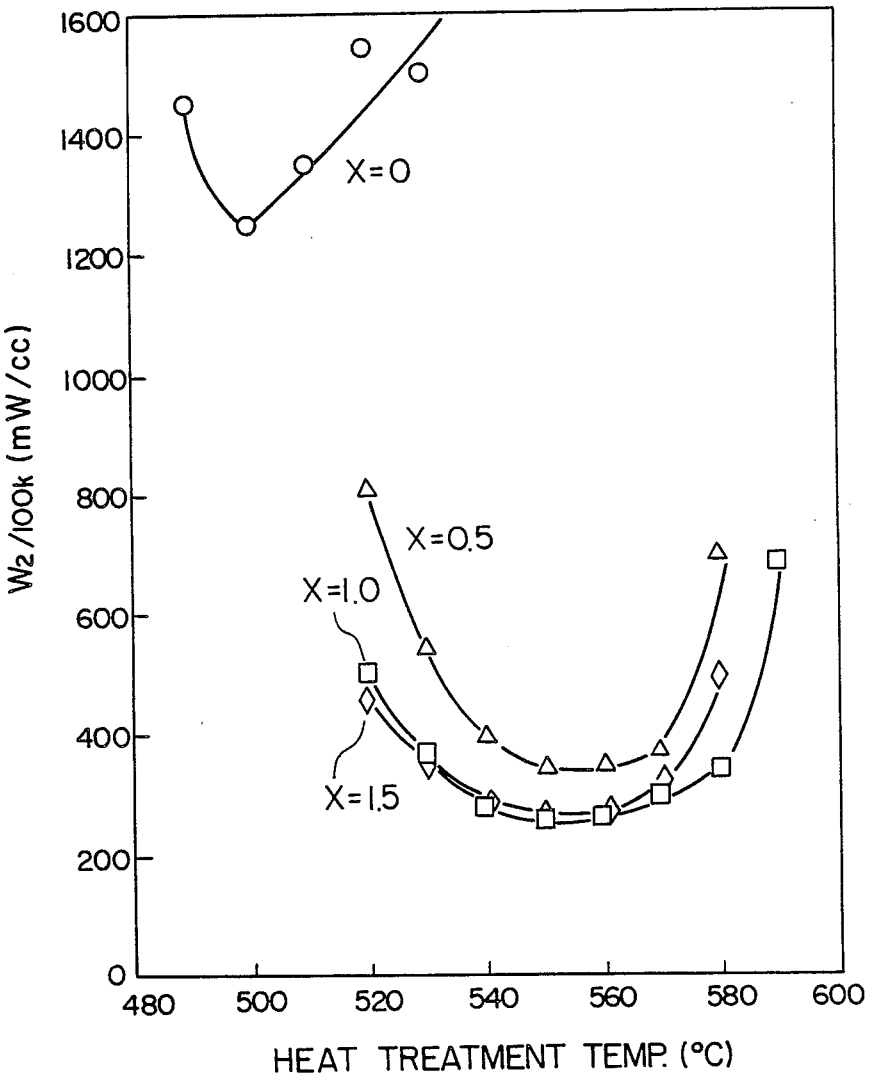
FIG. 12 is a graph showing the relations between heat treatment temperature and core loss with respect to the Fe-base soft magnetic alloy of Example 21.

As is clear from FIG. 12, when the Cu content x is 0, core loss $W_{2/100k}$ is extremely large, and when Cu is added the core loss becomes small and also a proper heat treatment temperature range becomes as high as 540°–580° C., exceeding that of those containing no Cu. This temperature is higher than the crystallization temperature Tx measured at a temperature-elevating speed of 10° C./minute by DSC. Incidentally, it was confirmed by transmission electron microscopy that the Fe-base soft magnetic alloy of the present invention containing Cu was constituted by 50% or more of fine crystalline particles.

EXAMPLE 22

Amorphous alloy ribbons having the composition of $Fe_{74.5-x}Cu_xMo_3Si_{13.5}B_9$ were heat-treated under the same conditions as in Example 15, and measured with respect to effective permeability at 1 kHz. The results are shown in FIG. 13.

Figure 13:
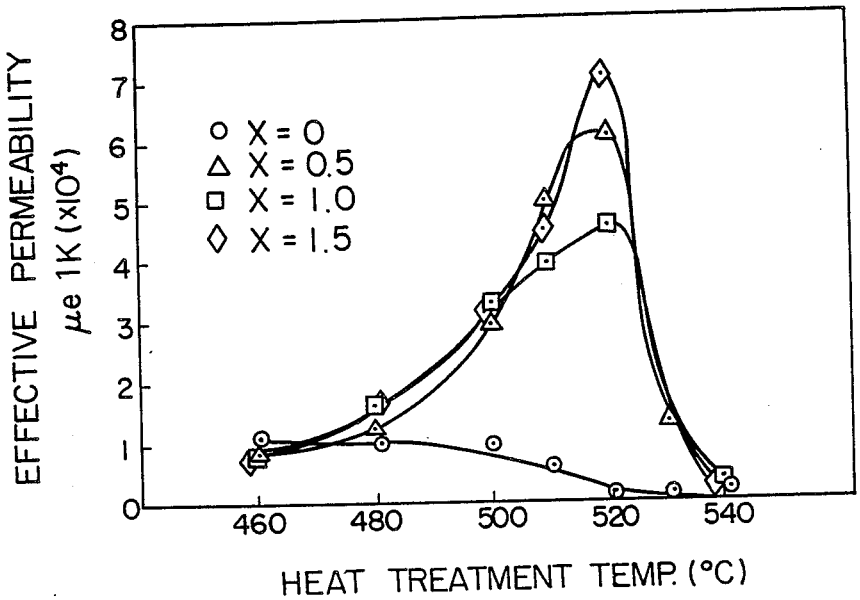
FIG. 13 is a graph showing the relations between heat treatment temperature and effective permeability of the Fe-base soft magnetic alloy of Example 22.

As is clear from FIG. 13, those containing no Cu (x=0) have reduced effective permeability μe under the same heat treatment conditions as in the present invention, while those containing Cu (present invention) have extremely enhanced effective permeability. The reason therefor is presumably that those containing no Cu (x=0) have large crystalline particles mainly composed of compound phases, while those containing Cu (present invention) have fine α-Fe crystalline particles in which Si and B are dissolved.

EXAMPLE 23

Amorphous alloy ribbons having the composition of $Fe_{73.5-x}Cu_xSi_{13.5}B_9Nb_3Mo_{0.5}V_{0.5}$ were heat-treated under the same conditions as in Example 15, and measured with respect to effective permeability at 1 kHz. The results are shown in FIG. 14.

Figure 14:
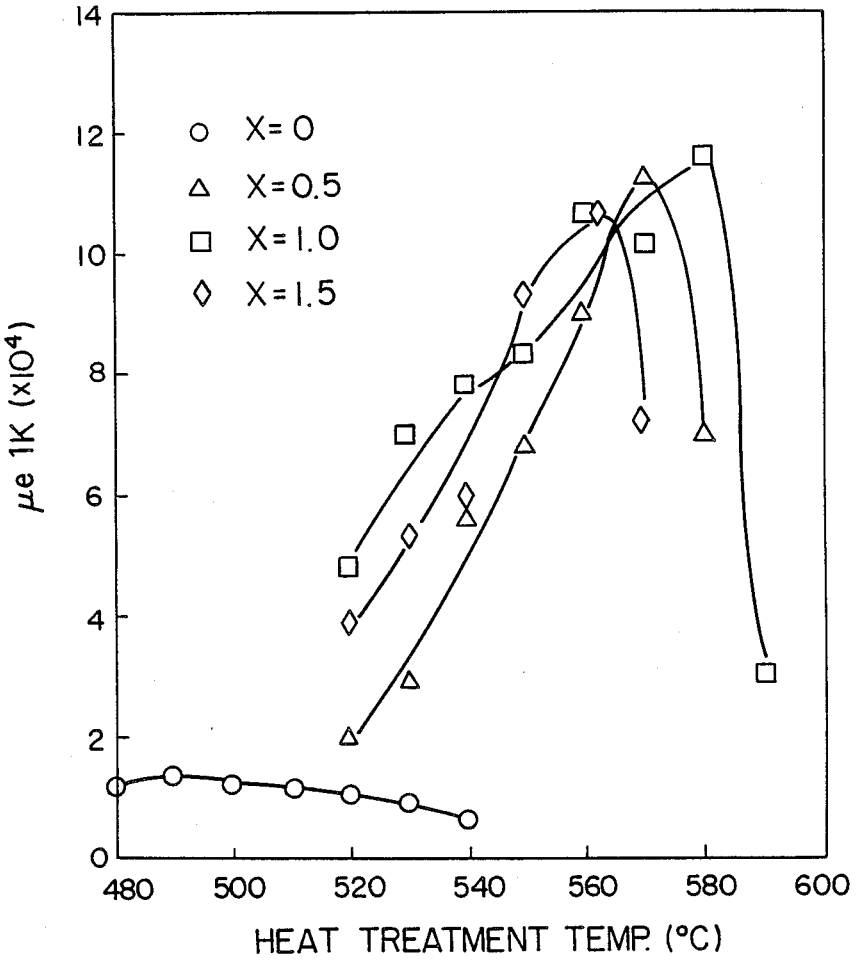
FIG. 14 is a graph showing the relations between effective permeability $\mu$elk and heat treatment temperature with respect to the Fe-base soft magnetic alloy of Example 23.

As is clear from FIG. 14, those containing no Cu (x=0) have reduced effective permeability μe under the same heat treatment conditions as in the present invention, while those containing Cu (present invention) have extremely enhanced effective permeability.

EXAMPLE 24

Amorphous alloy ribbons having the composition of $Fe_{74-x}Cu_xSi_{13}B_8Mo_3V_1Al_1$ were heat-treated under the same conditions as in Example 21, and measured with respect to effective permeability at 1 kHz. The results are shown in FIG. 15.

Figure 15:
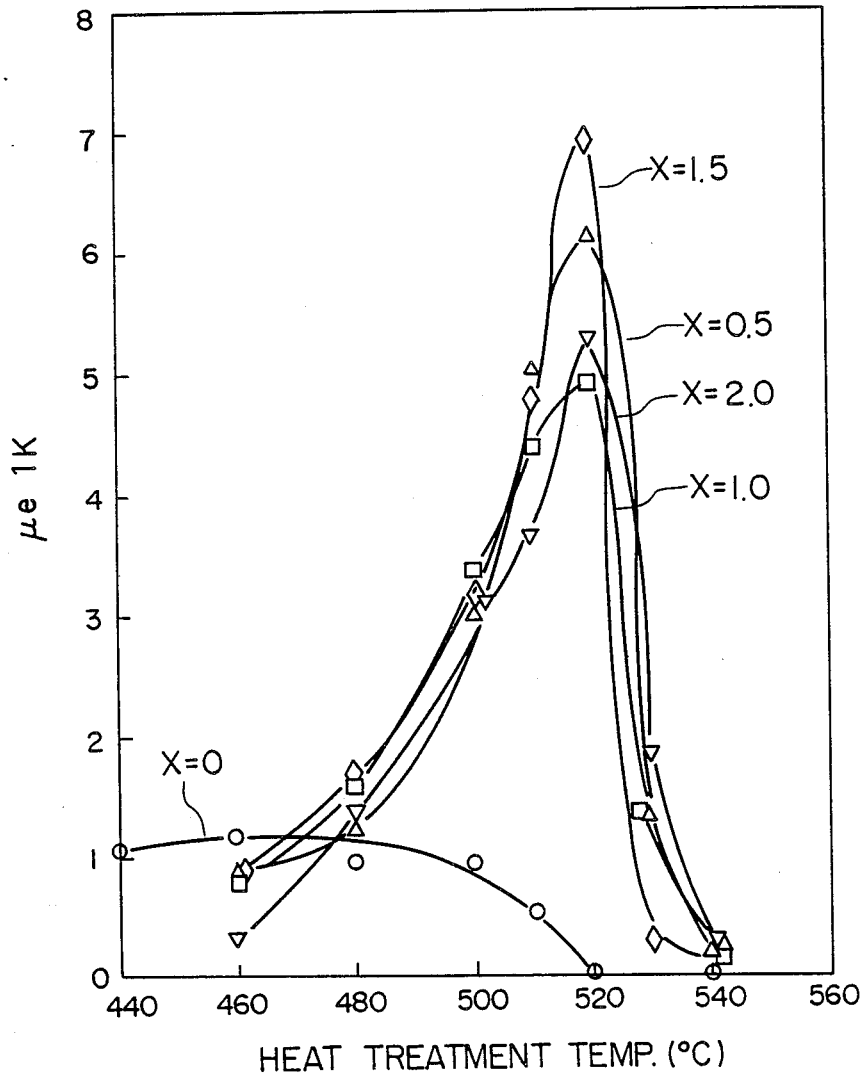
FIG. 15 is a graph showing the relations between effective permeability and heat treatment temperature with respect to the Fe-base soft magnetic alloy of Example 24.

As is clear from FIG. 15, those containing no Cu (x=0) have reduced effective permeability $\mu e$ under the same heat treatment conditions as in the present invention, while those containing Cu (present invention) have extremely enhanced effective permeability.

EXAMPLE 25

Amorphous alloys having the composition of $Fe_{x77.5-\alpha}Cu_xNb_{60}Si_{13.5}B_9$ were prepared in the same manner as in Example 1, and measured with respect to crystallization temperature at a temperature-elevating speed of 10° C./minute for various values of x and $\alpha$. The results are shown in FIG. 16.

Figure 16:
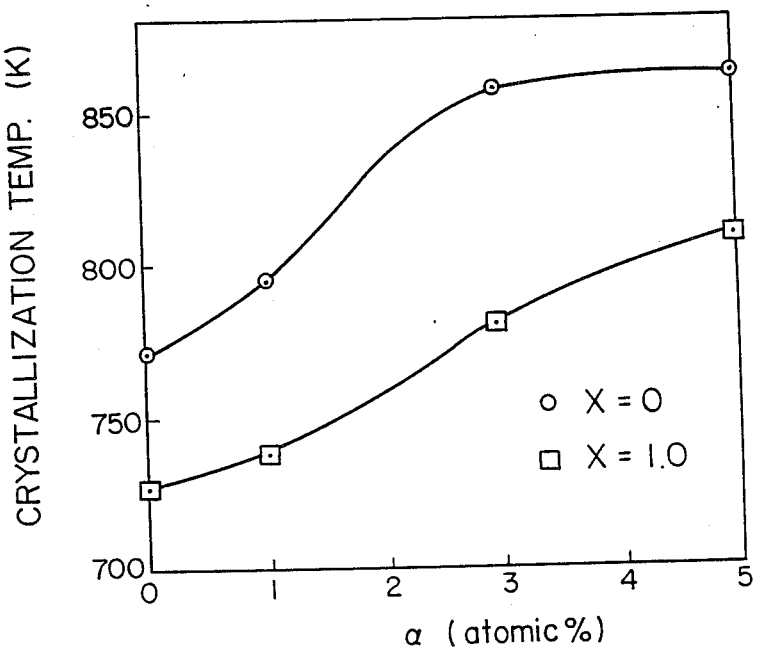
FIG. 16 is a graph showing the relations between Cu content (x) and Nb content ($\alpha$) and crystallization temperature with respect to the Fe-base soft magnetic alloy of Example 25.

As is clear from FIG. 16, Cu acts to lower the crystallization temperature, while Nb acts to enhance it. The addition of such elements having the opposite tendency in combination appears to make the precipitated crystalline particles finer.

EXAMPLE 26

Amorphous alloy ribbons having the composition of $Fe_{72-\beta}Cu_1Si_{15}B_9Nb_3Ru_\beta$ were punched in the shape for a magnetic head core and then heat-treated at 580° C. for one hour. A part of each ribbon was used for observing its microstructured by a transmission electron microscope, and the remaining parts of each sample was laminated to form a magnetic head. It was shown that the heat-treated samples consisted substantially of a fine crystalline particle structure.

Next, each of the resulting magnetic heads was assembled in an automatic reverse cassette tape recorder and subjected to a wear test at temperature of 20° C. and at humidity of 90%. The tape was turned upside down every 25 hours, and the amount of wear after 100 hours was measured. The results are shown in FIG. 17.

Figure 17:
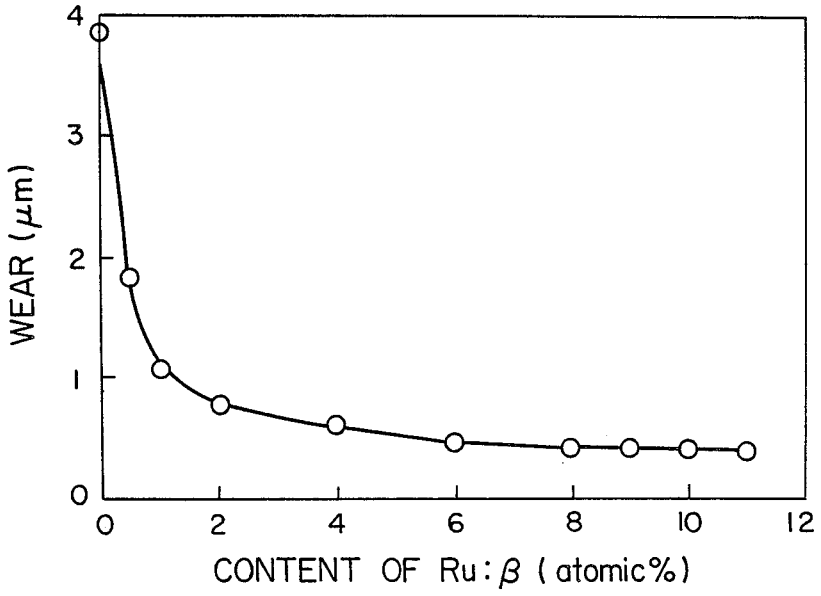
FIG. 17 is a graph showing wear after 100 hours of the Fe-base soft magnetic alloy of Example 26.

As is clear from FIG. 17, the addition of Ru extremely improves wear resistance, thereby making the alloy more suitable for magnetic heads.

EXAMPLE 27

Amorphous alloy ribbons of 25 μm in thickness and 15 mm in width and having the composition of $Fe_{76.5-\alpha}Cu_1Nb_\alpha Si_{13.5}B_9$ ($\alpha$=3, 5) were prepared by a single roll method. These amorphous alloys were heat-treated at temperatures of 500° C. or more for one hour. It was observed by an electron microscope that those heat-treated at 500° C. or higher were 50% or more crystallized.

Figure 18:
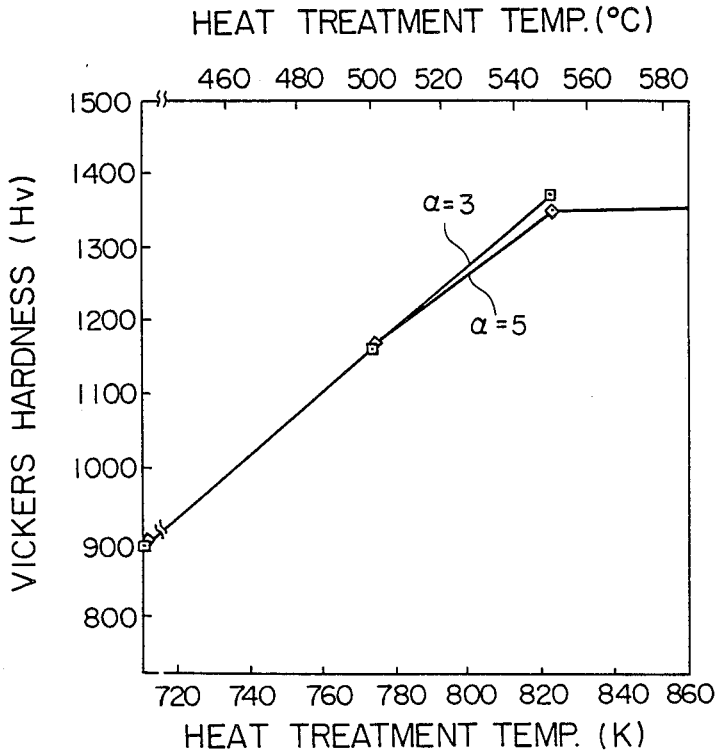
FIG. 18 is a graph showing the relations between Vickers hardness and heat treatment temperature with respect to the Fe-base soft magnetic alloy of Example 27.

The heat-treated alloys were measured with respect to Vickers hardness at a load of 100 g. FIG. 18 shows how the Vickers hardness varies depending upon the heat treatment temperature. It is shown that the alloy of the present invention has higher Vickers hardness than the amorphous alloys.

EXAMPLE 28

Amorphous alloy ribbons having the compositions as shown in Table 7 were prepared and heat-treated, and magnetic heads produced therefrom in the same way as in Example 26 were subjected to a wear test. Table 7 shows wears after 100 hours and corrosion resistance measured by a salt spray test.

The table shows that the alloys of the present invention containing Ru, Rh Pd, Os, Ir, Pt, Au, Cr, Ti, V, etc. have better wear resistance and corrosion resistance than those not containing the above elements, and much better than the conventional Co-base amorphous alloy. Further, since the alloy of the present invention can have a saturation magnetic flux density of 1T or more, it is suitable for magnetic head materials.

TABLE 7

| Sample No. | Alloy Composition (at %) | Wear (μm) | Corrosion Resistance |
|---|---|---|---|
| 1 | $(Fe_{0.98}Co_{0.02})_{70}Cu_1Si_{14}B_9Nb_3Cr_3$ | 2.2 | Excellent |
| 2 | $Fe_{70}Cu_1Si_{14}B_9Nb_3Ru_3$ | 0.7 | Excellent |
| 3 | $Fe_{69}Cu_1Si_{15}B_9Ta_3Ti_3$ | 2.1 | Good |
| 4 | $(Fe_{0.99}Ni_{0.01})_{70}Cu_1Si_{14}B_9Zr_3Rh_3$ | 0.8 | Excellent |
| 5 | $Fe_{70}Cu_1Si_{15}B_8Hf_3Pd_3$ | 0.7 | Excellent |
| 6 | $Fe_{69}Cu_1Si_{15}B_7Mo_5Os_3$ | 0.9 | Excellent |
| 7 | $Fe_{66.5}Cu_{1.5}Si_{14}B_{10}W_5Ir_3$ | 0.9 | Excellent |
| 8 | $Fe_{69}Cu_1Si_{13}B_9Nb_5Pt_3$ | 1.0 | Excellent |
| 9 | $Fe_{71}Cu_1Si_{13}B_9Nb_3Au_3$ | 1.0 | Excellent |
| 10 | $Fe_{71}Cu_1Si_{13}B_9Nb_3V_3$ | 2.3 | Good |
| 11 | $Fe_{70}Cu_1Si_{14}B_9Nb_3Cr_1Ru_2$ | 0.5 | Excellent |
| 12 | $Fe_{68}Cu_1Si_{14}B_{10}Nb_3Cr_1Ti_1Ru_2$ | 0.5 | Excellent |
| 13 | $Fe_{69}Cu_1Si_{14}B_9Nb_3Ti_1Ru_2Rh_1$ | 0.4 | Excellent |
| 14 | $Fe_{72}Cu_1Si_{15}B_6Nb_3Ru_2Rh_1$ | 0.4 | Excellent |
| 15 | $Fe_{73}Cu_{1.5}Nb_3Si_{13.5}B_9$ | 3.9 | Fair |
| 16 | $(Co_{0.94}Fe_{0.06})_{75}Si_{15}B_{10}$ Amorphous Alloy | 10.0 | Good |

Note:
16 Conventional alloy

EXAMPLE 29

Amorphous alloy ribbons of 10 mm in width and 30 μm in thickness and having the compositions as shown in Table 8 were prepared by a double-roll method. Each of the amorphous alloy ribbons was punched by a press to form a magnetic head core, and heat-treated at 550° C. for one hour and then formed into a magnetic head. It was observed by a transmission electron microscope that the ribbon after the heat treatment was constituted 50% or more by fine crystalline particles of 500 Å or less.

Part of the heat-treated ribbon was measured with respect to Vickers hardness under a load of 100 g and further a salt spray test was carried out to measure corrosion resistance thereof. The results are shown in Table 8.

Next, the magnetic head was assembled in a cassette tape recorder and a wear test was conducted at temperature of 20° C. and at humidity of 90%. The amount of wear after 100 hours are shown in Table 8.

It is clear from the table that the alloy of the present invention has high Vickers hardness and corrosion resistance and further excellent wear resistance, and so are suitable for magnetic head materials, etc.

TABLE 8

| Sample No. | Composition (at %) | Vickers Hardness Hv | Corrosion Resistance | Wear (μm) |
|---|---|---|---|---|
| 1 | $Fe_{68.5}Cu_1Si_{13.5}B_9Nb_3Cr_3C_2$ | 1350 | Good | 0.9 |
| 2 | $Fe_{68.5}Cu_{1.5}Si_{14}B_9Nb_3Ru_3C_1$ | 1380 | Good | 0.4 |
| 3 | $Fe_{67.5}Cu_{1.5}Si_{15}B_8Nb_5Rh_2Ge_1$ | 1400 | Good | 0.5 |
| 4 | $(Fe_{0.97}Ni_{0.03})_{67.5}Cu_1Si_{13.5}B_9Mo_5Ti_1Cr_2P_1$ | 1340 | Good | 0.8 |
| 5 | $(Fe_{0.95}Co_{0.05})_{67}Cu_1Si_{14}B_{10}Ta_3Cr_1Ru_3C_1$ | 1320 | Good | 0.3 |
| 6 | $Fe_{66}Cu_1Si_{15}B_8Nb_5Cr_1Pd_3Be_1$ | 1370 | Good | 0.3 |
| 7 | $Fe_{65}Cu_1Si_{15}B_8Nb_7Cr_1Ru_2C_1$ | 1350 | Good | 0.4 |
| 8 | $Fe_{67}Cu_1Si_{15}B_8Nb_5Ti_1Ru_2C_1$ | 1360 | Good | 0.4 |
| 9 | Permalloy | 100 | Good | 10.8 |
| 10 | $Co_{70}Fe_2Mn_5Si_{14}B_9$ | 900 | Fair | 9.8 |
| 11 | $Fe_{77}Nb_1Si_{13}B_9$ | 900 | Poor | 16.5 |

Note:
Nos. 9–11 Conventional alloys

EXAMPLE 30

Amorphous alloys having the composition of $Fe_{76.5-\alpha}Cu_1Nb_\alpha Si_{13.5}B_9$ were heat-treated at various temperatures for one hour, and the heat-treated alloys were measured with respect to magnetostriction λs. The results are shown in Table 9.

TABLE 9

| No. | Nb Content (α) (atomic %) | Magnetostriction at Each Temperature ($\times 10^{-6}$) —(1) | 480 | 500 | 520 | 550 | 570 | 600 | 650 |
|---|---|---|---|---|---|---|---|---|---|
| 1 | 3 | 20.7 | 18.6 | 2.6 | 8.0 | 3.8 | 2.2 | —(2) | —(2) |
| 2 | 5 | 13.3 | —(2) | 9.0 | 7.0 | 4.0 | —(2) | 0.6 | 3.4 |

Note:
(1)Not heat-treated
(2)Not measured

As is clear from Table 9, the magnetostriction is greatly reduced by the heat treatment of the present invention as compared to the amorphous state. Thus, the alloy of the present invention suffers from less deterioration of magnetic properties caused by magnetostriction than the conventional Fe-base amorphous alloys. Therefore, the Fe-base soft magnetic alloy of the present invention is useful as magnetic head materials.

EXAMPLE 31

Amorphous alloys having the composition of $Fe_{73-\alpha}Cu_1Si_{13}B_9Nb_3Ru_{0.5}C_{0.5}$ were heat-treated at various temperatures for one hour, and the heat-treated alloys were measured with respect to magnetostriction ls. The results are shown in Table 10.

TABLE 10

| Heat Treatment Temperature (°C.) | — | 500 | 550 | 570 | 580 |
|---|---|---|---|---|---|
| λs($\times 10^{-6}$) | +20.1 | +2.5 | +3.5 | +2.1 | +1.8 |

As is clear from Table 10, the magnetostriction is extremely low when heat-treated according to the present invention than in the amorphous state. Therefore, the Fe-base soft magnetic alloy of the present invention is useful as magnetic head materials. And even with resin impregnation and coating in the form of a wound core, it is less likely to be deteriorated in magnetic properties than the wound core of an Fe-base amorphous alloy.

EXAMPLE 32

Thin amorphous alloy ribbons of 5 mm in width and 18 μm in thickness and having the compositions as shown in Table 11 were prepared by a single roll method, and each of the ribbons was wound into a toroid of 19 mm in outer diameter and 15 mm in inner diameter, and then heat-treated at temperatures higher than the crystallization temperature. They were then measured with respect to DC magnetic properties, effective permeability μelk at 1 kHz and core loss $W_{2/100k}$ at 100 kHz and 2 kG. Saturation magnetization λs was also measured. The results are shown in Table 11.

TABLE 11

| Sample No. | Composition (at %) | | | | $W_{2/100K}$ (mW/cc) | λs ($\times 10^{-4}$) |
|---|---|---|---|---|---|---|
| 1 | $(Fe_{0.959}Ni_{0.041})_{73.5}Cu_1Si_{13.5}B_9Nb_3$ | 12.3 | 0.018 | 32000 | 280 | +4.6 |
| 2 | $(Fe_{0.93}Ni_{0.07})_{73.5}Cu_1Si_{13.5}B_9Nb_3$ | 12.1 | 0.023 | 18000 | 480 | +4.8 |
| 3 | $(Fe_{0.905}Ni_{0.095})_{73.5}Cu_1Si_{13.5}B_9Nb_3$ | 11.8 | 0.020 | 16000 | 540 | +5.0 |
| 4 | $(Fe_{0.986}Co_{0.014})_{73.5}Cu_1Si_{13.5}B_9Nb_3$ | 12.6 | 0.011 | 82000 | 280 | +4.0 |
| 5 | $(Fe_{0.959}Co_{0.041})_{73.5}Cu_1Si_{13.5}B_9Nb_3$ | 13.0 | 0.015 | 54000 | 400 | +4.2 |
| 6 | $(Fe_{0.93}Co_{0.07})_{73.5}Cu_1Si_{13.5}B_9Nb_3$ | 13.2 | 0.020 | 27000 | 500 | +4.8 |
| 7 | $Fe_{71.5}Cu_1Si_{15.5}B_7Nb_5$ | 10.7 | 0.012 | 85000 | 230 | +2.8 |
| 8 | $Fe_{71.5}Cu_1Si_{17.5}B_5Nb_5$ | 10.2 | 0.010 | 80000 | 280 | +2.0 |
| 9 | $Fe_{71.5}Cu_1Si_{19.5}B_5Nb_5$ | 9.2 | 0.065 | 8000 | 820 | +1.6 |
| 10 | $Fe_{70.5}Cu_1Si_{20.5}B_5Nb_3$ | 10.8 | 0.027 | 23000 | 530 | ~0 |
| 11 | $Fe_{75.5}Cu_1Si_{13.5}B_7Nb_3$ | 13.3 | 0.011 | 84000 | 250 | +1.5 |

EXAMPLE 33

Figure 19:
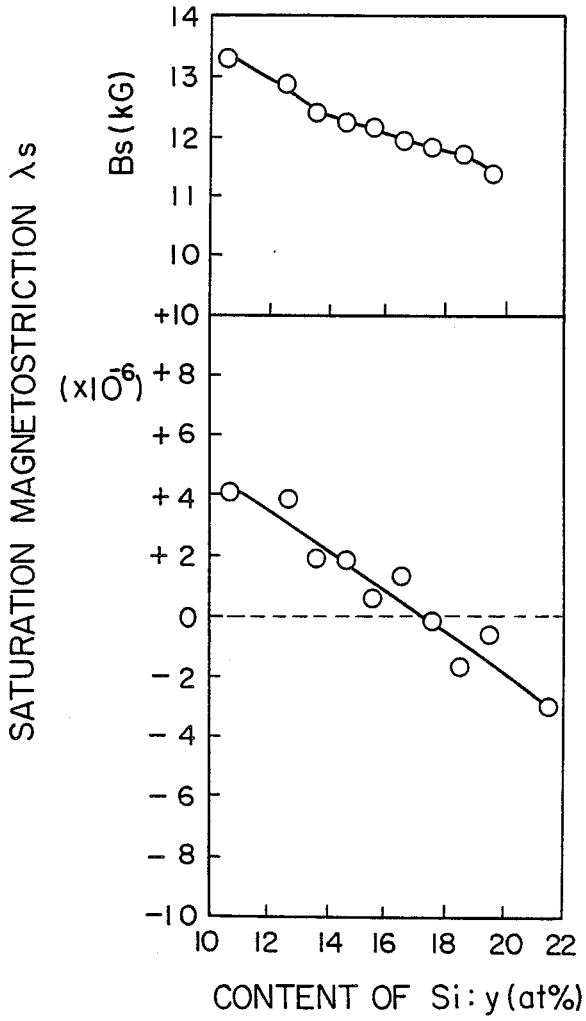
FIG. 19 is a graph showing the dependency of saturation magnetostriction ($\lambda$s) and saturation magnetic flux density (Bs) on y with respect to the alloy of $Fe_{73.5}Cu_1Nb_3Si_yB_{22.5-y}$ of Example 33.

FIG. 19 shows the saturation magnetostriction λs and saturation magnetic flux density Bs of an alloy of $Fe_{73.5}Cu_1Nb_3Si_yB_{22.5-y}$.

It is shown that as the Si content (y) increases, the magnetostriction changes from positive to negative, and that when y is nearly 17 atomic % the magnetostriction is almost 0.

Bs monotonously decreases as the Si content (y) increases, but its value is about 12 KG for a composition which has magnetostriction of 0, higher than that of the Fe-Si-Al alloy, etc. by about 1 KG. Thus, the alloy of the present invention is excellent as magnetic head materials.

EXAMPLE 34

Figure 20:
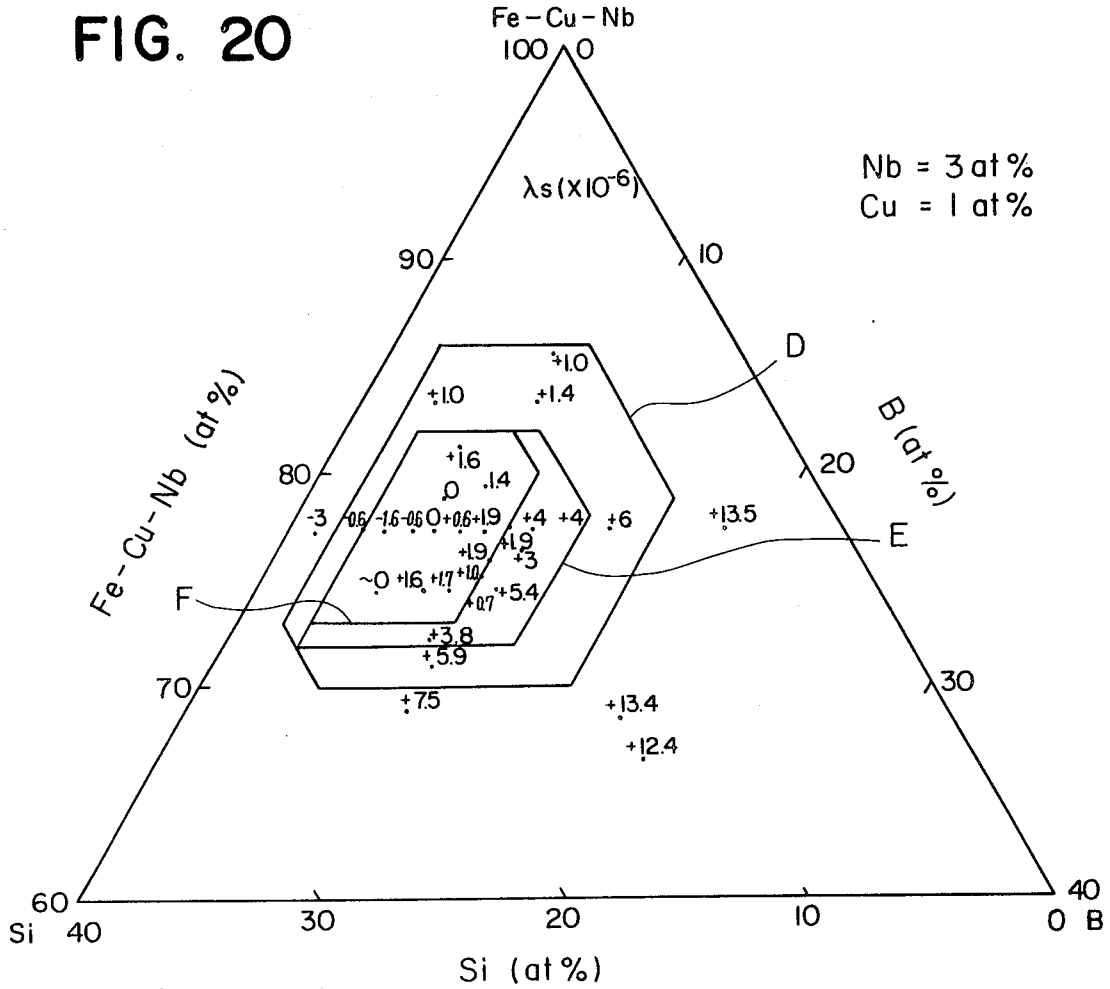
FIG. 20 is a graph showing the saturation magnetostriction ($\lambda$s) of the ($Fe$-$Cu_1$-$Nb_3$)-Si-B pseudo-ternary alloy.
Figure 21:
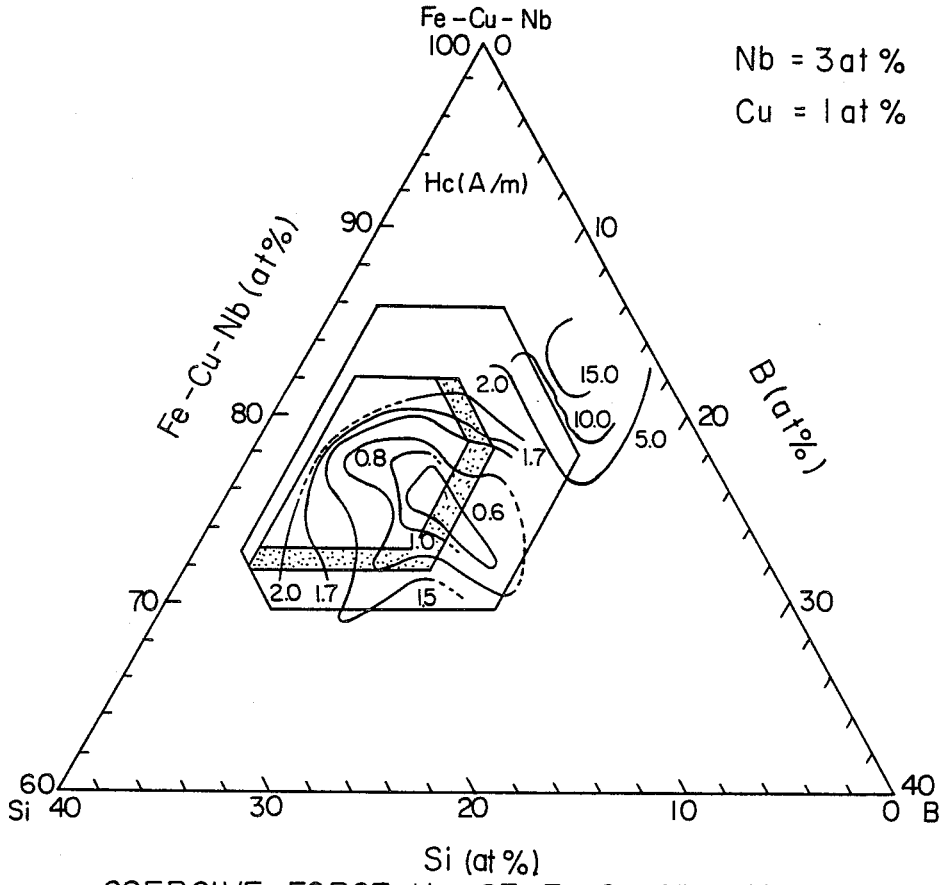
FIG. 21 is a graph showing the coercive force (Hc) of the ($Fe$-$Cu_1$-$Nb_3$)-Si-B pseudo-ternary alloy.
Figure 22:
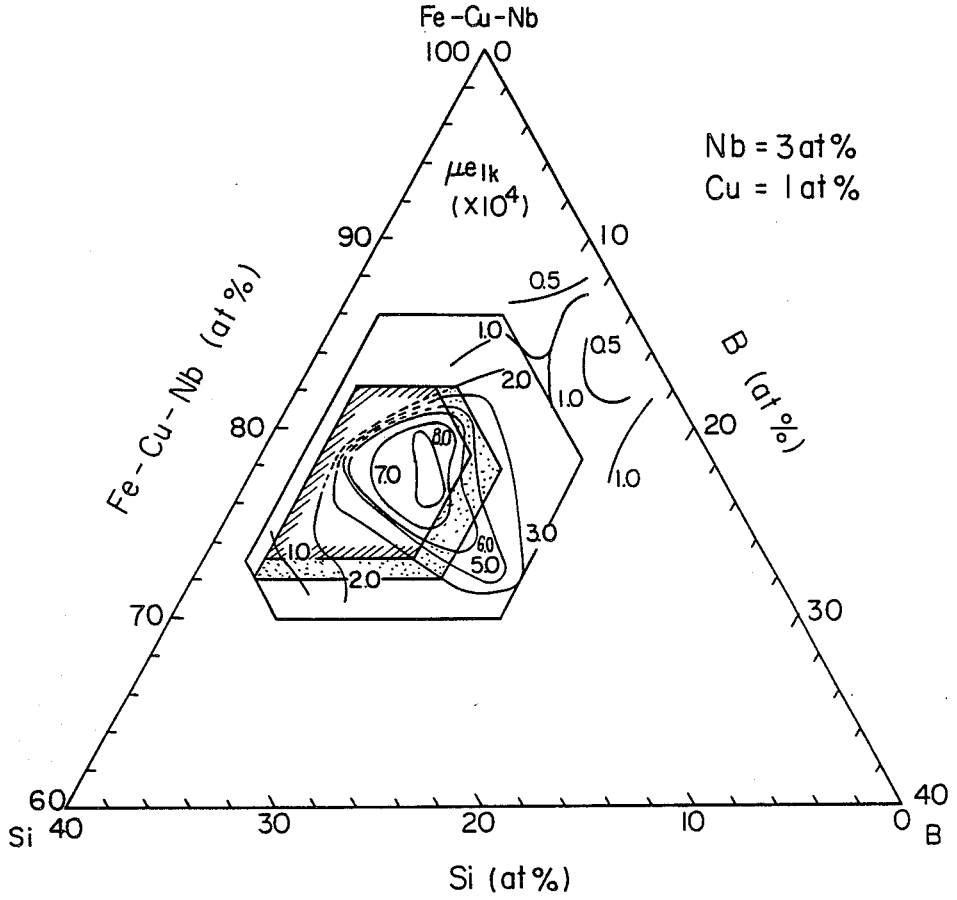
FIG. 22 is a graph showing the effective permeability $\mu$elk at 1 kHz of the ($Fe$-$Cu_l$-$Nb_3$)-Si-B pseudo-ternary alloy.
Figure 23:
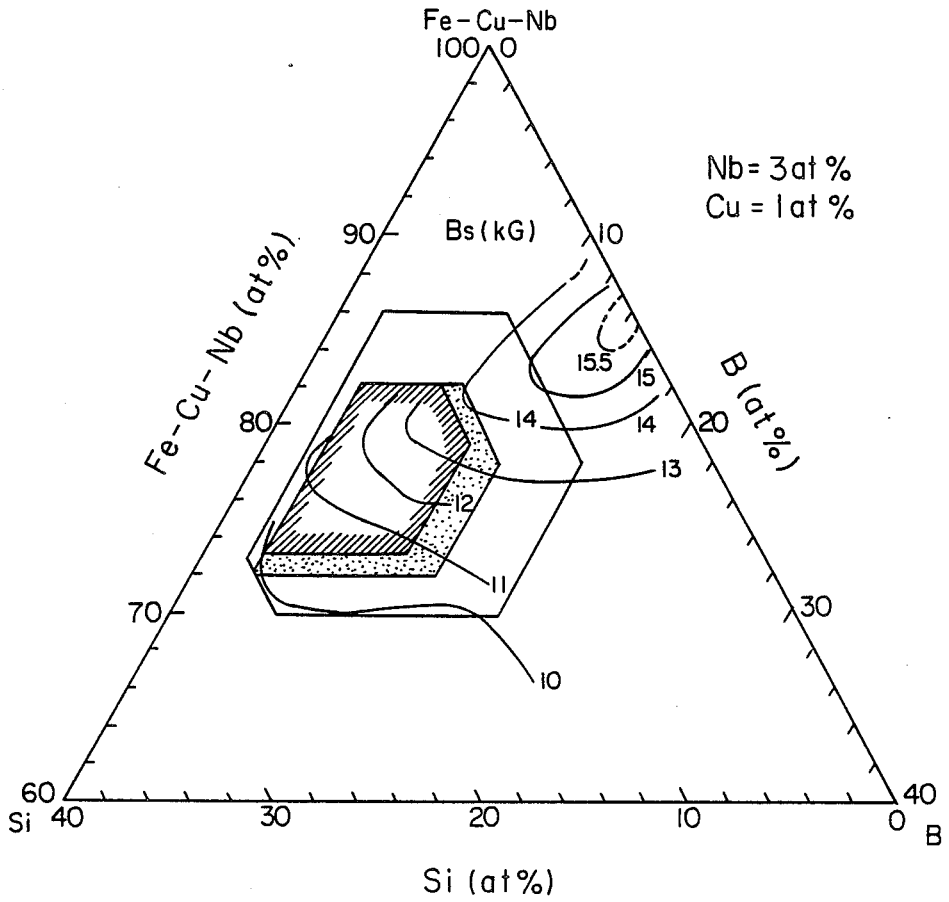
FIG. 23 is a graph showing saturation magnetic flux density (Bs) of the ($Fe$-$Cu_1$-$Nb_3$)-Si-B pseudo-ternary alloy.
Figure 24:
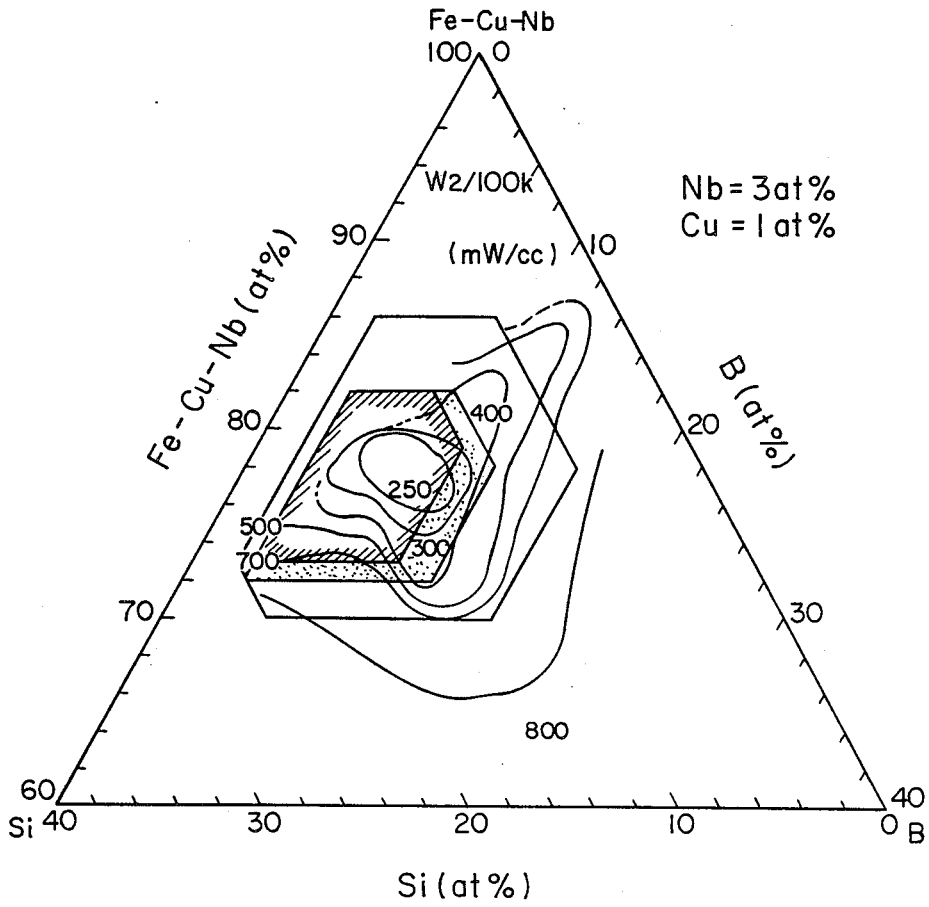
FIG. 24 is a graph showing the core loss $W_{2/100k}$ at 100 kHz and 2 kG of the ($Fe$-$Cu_1$-$Nb_3$)-Si-B pseudo-ternary alloy.

With respect to a pseudo-ternary alloy of $(Fe\text{-}Cu_1\text{-}Nb_3)\text{-}Si\text{-}B$, its saturation magnetostriction λs is shown in FIG. 20, its coercive force Hc in FIG. 21, its effective permeability $\mu e_{1K}$ at 1 kHz in FIG. 22, its saturation magnetic flux density Bs in FIG. 23 and its core loss $W_{2/100k}$ at 100 kHz and 2 KG in FIG. 24. FIG. 20 shows that in the composition range of the present invention enclosed by the curved line D, the alloy have a low magnetostriction λs of $10\times10^{-6}$ or less. And in the range enclosed by the curved line E, the alloy have better soft magnetic properties and smaller magnetostriction. Further, in the composition range enclosed by the curved line F, the alloy has further improved magnetic properties and particularly smaller magnetostriction.

It is shown that when the contents of Si and B are respectively $10\leqq y\leqq25$, $3\leqq z\leqq12$ and the total of Si and B (y+z) is in the range of 18–28, the alloy has a low magnetostriction $|\lambda s|\leqq5\times10^{-6}$ and excellent soft magnetic properties.

Particularly when $11\leqq y\leqq24$, $3\leqq z\leqq9$ and $18\leqq y+z\leqq27$, the alloy is highly likely to have a low magnetostriction $\lambda s\leqq1.5\times10^{-6}$. The alloy of the present invention may have magnetostriction of almost 0 and saturation magnetic flux density of 10 KG or more. Further, since it has permeability and core loss comparable to those of the Co-base amorphous alloys, the alloy of the present invention is highly suitable for various transformers, choke coils, saturable reactors, magnetic heads, etc.

EXAMPLE 35

Figure 25:
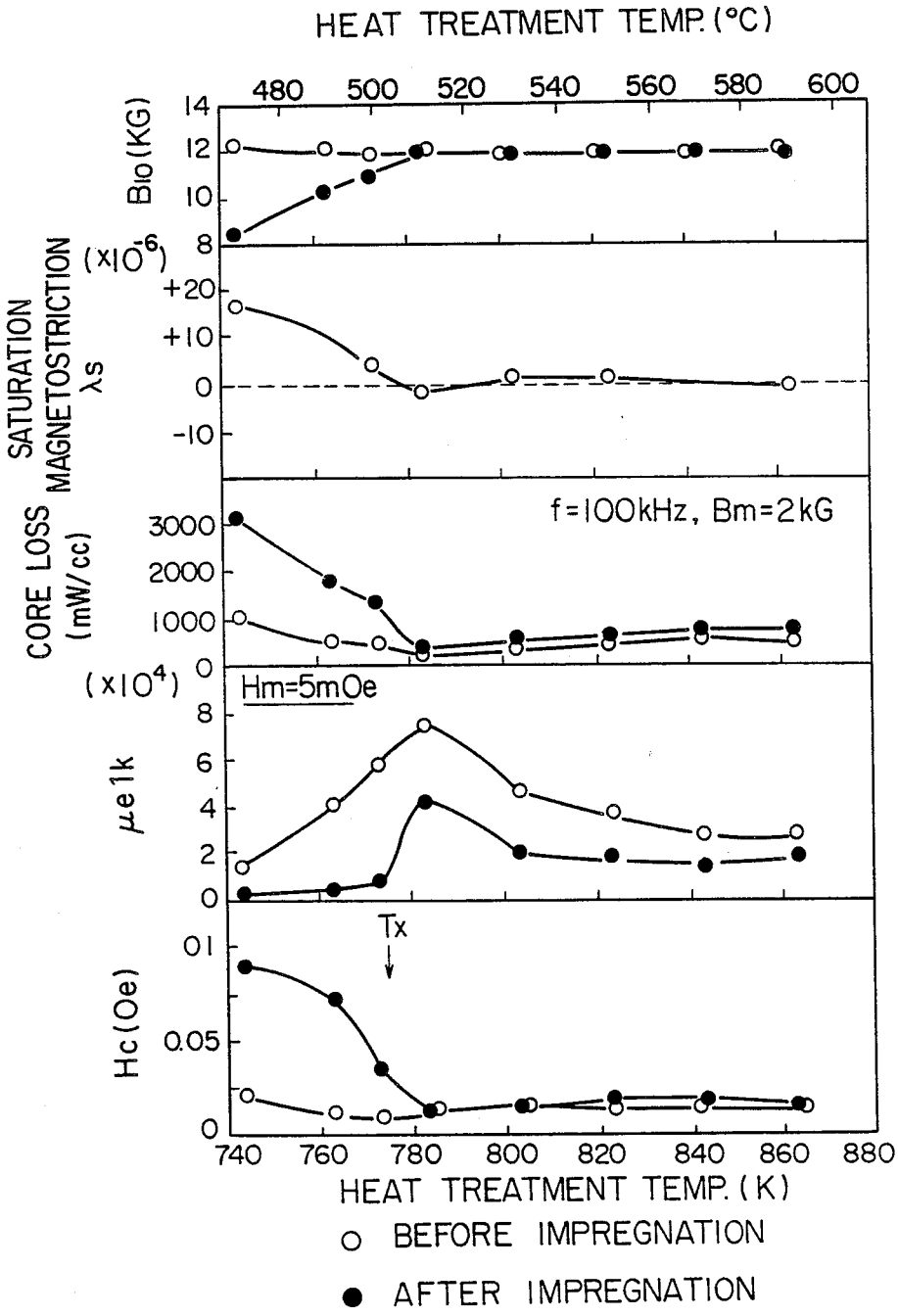
FIG. 25 is a graph showing the dependency of magnetic properties on heat treatment with respect to the alloy of Example 35.

A toroidal wound core of 19 mm in outer diameter, 15 mm in inner diameter and 5 mm in height constituted by a 18-μm amorphous alloy ribbon of $Fe_{73.5}Cu_1Nb_3Si_{16.5}B_6$ was heat-treated at various temperatures for one hour (temperature-elevating speed: 10 K/minute), air-cooled and then measured with respect to magnetic properties before and after impregration with an epoxy resin. The results are shown in FIG. 25. It also shows the dependency of λs on heat treatment temperature.

By heat treatment at temperatures higher than the crystallization temperature (Tx) to make the alloy structure have extremely fine crystalline particles, the alloy has magnetostriction extremely reduced to almost 0. This in turn minimizes the deterioration of magnetic properties due to resin impregnation. On the other hand, the alloy of the above composition mostly composed of an amorphous phase due to heat treatment at temperatures considerably lower than the crystallization temperature, for instance, at 470° C. does not have good magnetic properties even before the resin impregnation, and after the resin impregnation it has extremely increased core loss and coercive force Hc and extremely decreased effective permeability $\mu e_{1K\,at}$ 1 kHz. This is due to a large saturation magnetostriction λs. Thus. it is clear that as long as the alloy is in an amorphous state, it cannot have sufficient soft magnetic properties after the resin impregnation.

The alloy of the present invention containing fine crystalline particles have small λs which in turn minimizes the deterioration of magnetic properties, and thus its magnetic properties are comparable to those of Co-base amorphous alloys having λs of almost 0 even after the resin impregnation. Moreover, since the ally of the present invention has a high saturation magnetic flux density as shown by magnetic flux density $B_{10}$ of 12 KG or so at 10 Oe, it is suitable for magnetic heads, transformers, choke coils, saturable reactors, etc.

EXAMPLE 36

3 μm-thick amorphous alloy layers having the compositions as shown in Table 12 were formed on a crystallized glass (Photoceram: trade name) substrates by a magnetron sputtering apparatus. Next, each of these layers was heat-treated at temperature higher than the crystallization temperature thereof in an $N_2$ gas atmosphere in a rotational magneticfield of 5000 Oe to provide the alloy layer of the present invention with extremely fine crystalline particles. Each of them was measured with respect to effective permeability $\mu e_{1M}$ at 1 MHz and saturation magnetic flux density Bs. The results are shown in Table 12.

TABLE 12

| Sample No. | Composition (at %) | μelM | Bs (KG) |
|---|---|---|---|
| 1 | $Fe_{71.5}Cu_{1.1}Si_{15.5}B_{7.0}Nb_{5.1}$ | 2700 | 10.7 |
| 2 | $Fe_{71.7}Cu_{0.9}Si_{16.5}B_{6.1}Nb_{4.9}$ | 2700 | 10.5 |
| 3 | $Fe_{71.3}Cu_{1.1}Si_{17.5}B_{5.2}Nb_{4.9}$ | 2800 | 10.3 |
| 4 | $Fe_{74.8}Cu_{1.0}Si_{12.0}B_{9.1}Nb_{3.1}$ | 2400 | 12.7 |
| 5 | $Fe_{71.0}Cu_{1.1}Si_{16.0}B_{9.0}Nb_{2.9}$ | 2500 | 11.4 |
| 6 | $Fe_{69.8}Cu_{1.0}Si_{15.0}B_{9.1}Mo_{5.1}$ | 2400 | 10.1 |
| 7 | $Fe_{73.2}Cu_{1.0}Si_{13.5}B_{9.1}Ta_{3.2}$ | 2300 | 11.4 |
| 8 | $Fe_{71.5}Cu_{1.0}Si_{13.6}B_{8.9}W_{5.0}$ | 2200 | 10.0 |
| 9 | $Fe_{73.2}Cu_{1.1}Si_{17.5}B_{5.1}Nb_{3.1}$ | 2900 | 11.9 |
| 10 | $Fe_{70.4}Cu_{1.1}Si_{13.5}B_{12.0}Nb_{3.0}$ | 2200 | 11.2 |
| 11 | $Fe_{78.7}Cu_{1.0}Si_{8.2}B_{9.1}Nb_{3.0}$ | 1800 | 14.5 |
| 12 | $Fe_{76.9}Cu_{0.9}Si_{10.2}B_{8.9}Nb_{3.1}$ | 2000 | 14.3 |
| 13 | $Fe_{74.5}Nb_3Si_{17.5}B_5$ Amorphous Alloy | 50 | 12.8 |
| 14 | $Co_{87.0}Nb_{5.0}Zr_{8.0}$ Amorphous Alloy | 2500 | 12.0 |
| 15 | $Fe_{74.7}Si_{17.9}Al_{7.4}$ Alloy | 1500 | 10.3 |

Note:
Nos. 13–15 Conventional alloys

EXAMPLE 37

Figure 26:
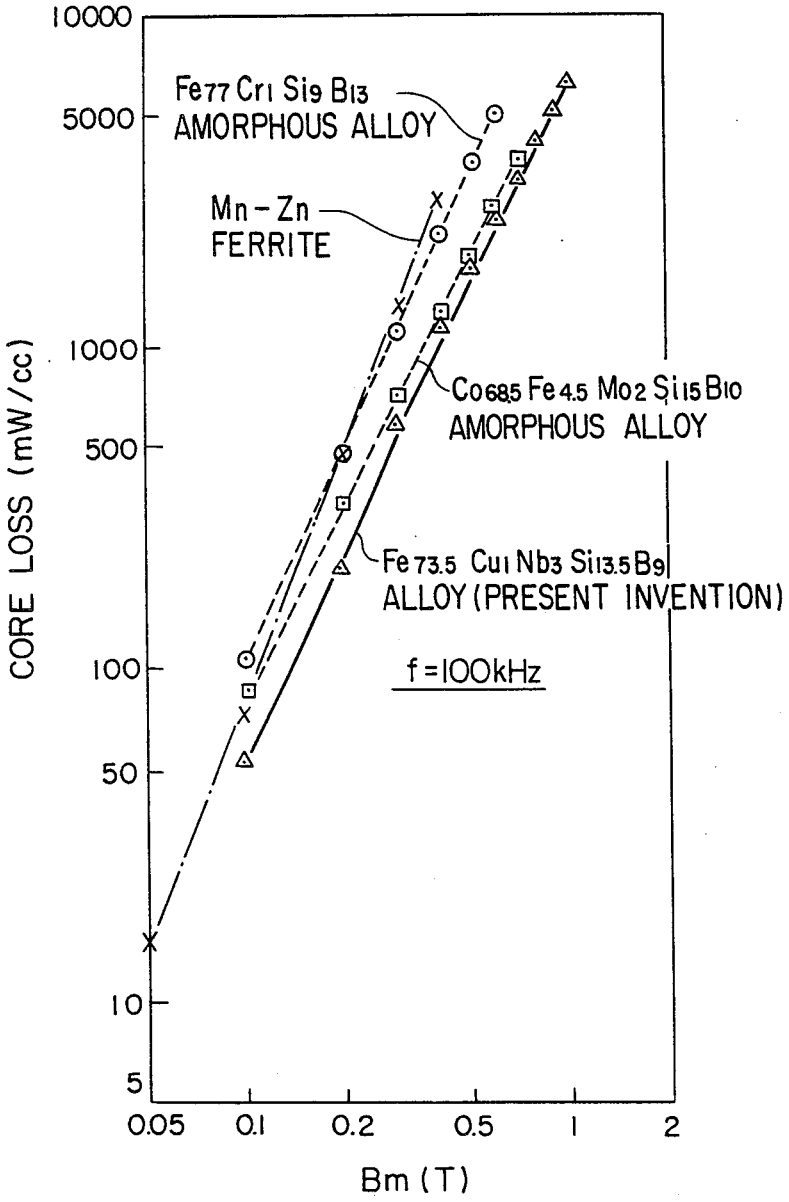
FIG. 26 is a graph showing the dependency of core loss on Bm in Example 37.

Amorphous alloy ribbons of 18 μm in thickness and 5 mm in width and having the composition of $Fe_{73.5}Cu_1Nb_3Si_{13.5}B_9$ were prepared by as single roll method and formed into toroidal wound cores of 19 mm in outer diameter and 15 mm in inner diameter. These amorphous alloy wound cores were heat-treated at 550° C. for one hour and then air-cooled. Each of the wound cores thus heat-treated was measured with respect to core loss at 100 kHz to investigate its dependency on Bm. FIG. 26 shows the dependency of core loss on Bm. For comparison, the dependency of core loss on Bm is shown also for wound cores of an Co-base amorphous alloy ($Co_{68.5}Fe_{4.5}Mo_2Si_{15}B_{10}$), wound cores of an Fe-base amorphous alloy ($Fe_{77}Cr_1Si_9B_{13}$) and Mn-Zn ferrite.

FIG. 26 shows that the wound cores made of the alloy of the present invention have lower core loss than those of the conventional Fe-base amorphous alloy, the Co-base amorphous alloy and the ferrite. Accordingly, the alloy of the present invention is highly suitable for high-frequency transformers, choke coils, etc.

EXAMPLE 38

An amorphous alloy ribbon of $Fe_{70}Cu_1Si_{14}B_9Nb_5Cr_1$ of 15 μm in thickness and 5 mm in width was prepared by a single roll method and form into a wound core of 19 mm in outer diameter and 15 mm in inner diameter. It was then heat-treated by heating at a temperature-elevating speed of 5° C./min. while applying a magnetic field of 3000 Oe in perpendicular to the magnetic path of the wound core, keeping it at 620° C. for one hour and then cooling it at a speed of 5° C./min. to room temperature. Core loss was measured on it. It was confirmed by transmission electron microscopy that the alloy of the present invention had fine crystalline particles. Its direct current B-H curve had a squareness ratio of 8%, which means that it is highly constant in permeability.

For comparison, an Fe-base amorphous alloy ($Fe_{77}Cr_1Si_9B_{13}$), a Co-base amorphous alloy ($Co_{67}Fe_4Mo_{1.5}Si_{16.5}B_{11}$), and Mn-Zn ferrite were measured with respect to core loss.

Figure 27:
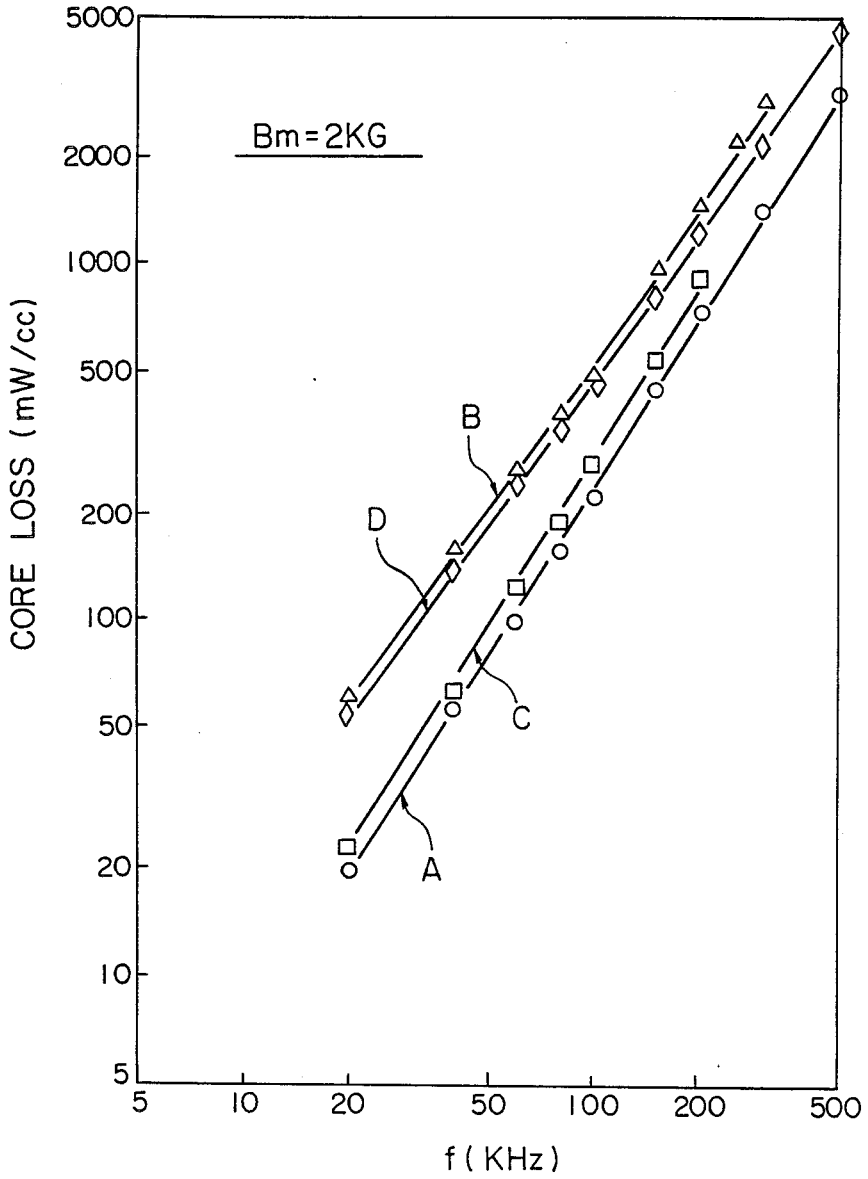
FIG. 27 is a graph showing the relations between core loss and frequency with respect to the Fe-base soft magnetic alloy of the present invention, the conventional Fe-base amorphous alloy, the Co-base amorphous alloy and the ferrite in Example 38.
Figure 28A:
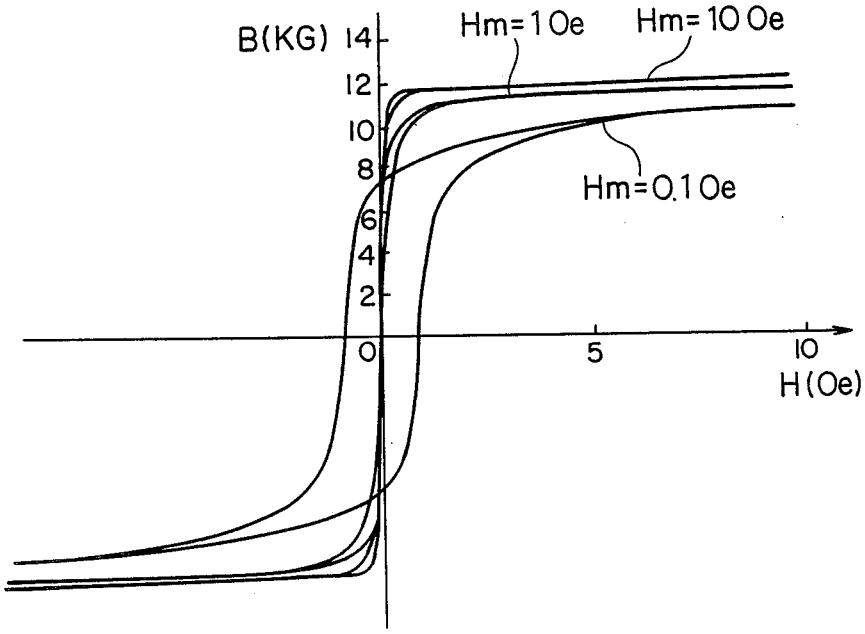
FIGS. 28 (*a*)–(*d*) are respectively graphs showing the direct current B-H curves of the alloys of the present invention in Example 39.
Figure 28B:
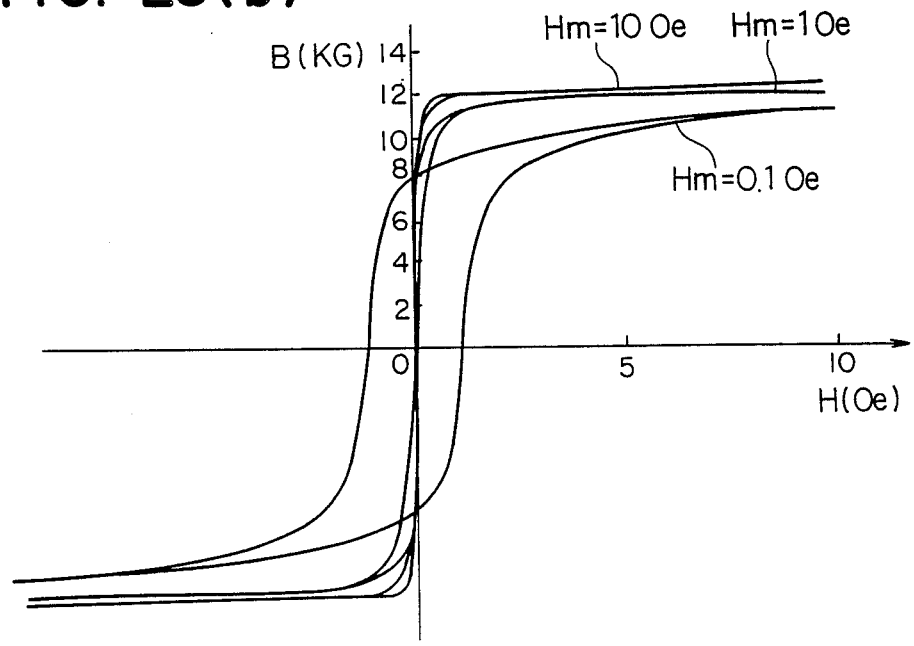
Figure 28C:
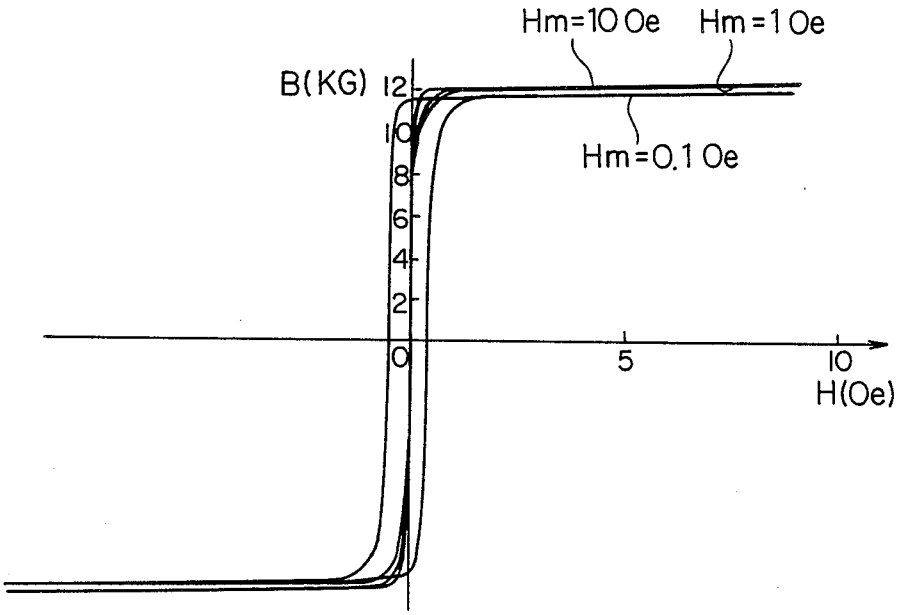
Figure 28D:
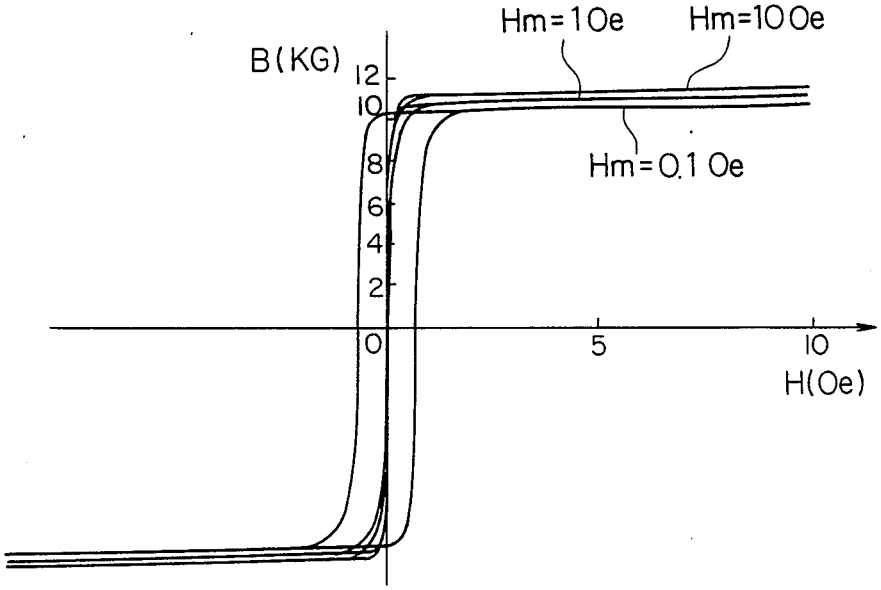

FIG. 27 shows the frequency dependency of core loss, in which A denotes the alloy of the present invention, B the Fe-base amorphous alloy, C the Co-base amorphous alloy and D the Mn-Zn ferrite. As is clear, from the figure. the Fe-base soft magnetic alloy of the present invention has a core loss which is comparable to that of the conventional Co-base amorphous alloy and much smaller than that of the Fe-base amorphous alloy.

EXAMPLE 39

An amorphous alloy ribbon of 5 mm in width and 15 μm in thickness was prepared by a single roll method. The composition of each amorphous alloy was as follows:

$Fe_{73.2}Cu_1Nb_3Si_{13.8}B_9$
$Fe_{73.5}Cu_1Mo_3Si_{13.5}B_9$
$Fe_{73.5}Cu_1Nb_3Si_{13.5}B_9$
$Fe_{71.5}Cu_1Nb_5Si_{13.5}B_9$

Next, a ribbon of each amorphous alloy was wound to form a toroidal wound core of 15 mm in inner diameter and 19 mm in outer diameter. The resulting wound core was heat-treated in a nitrogen atmosphere under the following conditions to provide the alloy of the present invention. It was observed by an electron microscope that each alloy was finely crystallized, 50% or more of which was constituted by fine crystalline particles.

Next, a direct current B-H curve was determined on each alloy. FIGS. 28 (*a*) to (*d*) show the direct current B-H curve of each wound core. FIG. 28 (*a*) shows the direct current B-H curve of a wound core produced from an alloy of the composition of $Fe_{73.2}Cu_1Nb_3Si_{13.8}B_9$ (heat treatment conditions: heated at 550° C. for one hour and then air-cooled), FIG. 28 (*b*) the direct current B-H curve of a wound core produced from an alloy of the composition of $Fe_{73.5}Cu_1Mo_3Si_{13.5}B_9$ (heat treatment conditions: heated at 530° C. for one hour and then air-cooled), FIG. 28 (*c*) the direct current B-H curve of a wound core produced from an alloy of the composition of $Fe_{73.5}Cu_1Nb_3Si_{13.5}B_9$ (heat treatment conditions: keeping at 550° C. for one hour, cooling to 280° C. at a speed of 5° C./min. while applying a magnetic field of 10 Oe in parallel to the magnetic path of the wound core, keeping at that temperature for one hour and then air-cooling), and FIG. 28 (*d*) the direct current B-H curve of a wound core produced from an alloy of the composition of $Fe_{71.5}Cu_1Nb_5Si_{13.5}B_9$ (heat treatment conditions: keeping at 610° C. for one hour, cooling to 250° C. at a speed of 10° C./min. while applying a magnetic field of 10 Oe in parallel to the magnetic path of the wound core, keeping at that time for 2 hours and then cir-cooling).

In each graph, the abscissa is Hm (maximum value of the magnetic field)=10 Oe. Accordingly, in the case of Hm=1 Oe, 10 is regarded as 1, and in the case of Hm=0.1 Oe, 10 is regarded as 0.1. In each graph, all of the B-H curves are the same except for differenc in the abscissa.

The Fe-base soft magnetic alloy shown in each graph had the following saturation magnetic flux density $B_{10}$, coercive force Hc, squareness ratio $Br/B_{10}$.

| | $B_{10}$ (kG) | $H_c$ (Oe) | $Br/B_{10}$ (%) |
|---|---|---|---|
| FIG. 28 (a) | 12.0 | 0.0088 | 61 |
| FIG. 28 (b) | 12.3 | 0.011 | 65 |
| FIG. 28 (c) | 12.4 | 0.0043 | 93 |
| FIG. 28 (d) | 11.4 | 0.0067 | 90 |

In the cases of (*a*) and (*b*) heat-treated without applying a magnetic field, the squareness ratio is medium (60% or so). while in the cases of (*c*) and (*d*) heat-treated while applying a magnetic field in parallel to the magnetic path, the squareness ratio is high (90% or more). The coercive force can be 0.01 Oe or less, almost comparable to that of the Co-base amorphous alloy.

In the case of heat treatment without applying a magnetic field, the effective permeability μe is several tens of thausand to 100,000 at 1 kHz, suitable for various inductors, sensors, transformers, etc. On the other hand. in the case of heat treatment while applying a magnetic field in parallel to the magnetic path of the wound core, a high squareness ratio is obtained and also the core loss is 800 mW/cc at 100 kHz and 2 kG, almost comparable to that of Co-base amorphous alloys. Thus, it is suitable for saturable reactors, etc.

And some of the alloys of the present invention have a saturation magnetic flux density exceeding 10 kG as shown in FIG. 28, which is higher than those of the conventional Permalloy and Sendust and general Co-base amorphous alloys. Thus, the alloy of the present invention can have a large operable magnetic flux density. Therefore, it is advantageous as magnetic materials for magnetic heads, transformers, saturable reactors, chokes. etc.

Also, in the case of heat treatment in a magnetic field in parallel to the magnetic path, the alloy of the present invention may have a maximum permeability μm exceeding 1,400,000, thus making it suitable for sensors.

EXAMPLE 40

Two amorphous alloy ribbons of $Fe_{73.5}Cu_1Nb_3Si_{13.5}B_9$ and $Fe_{74.5}Nb_3Si_{13.5}B_9$ both having a thickness of 20μm and a width of 10 mm were prepared by a single roll method, and X-ray diffraction was measured before and after heat treatment.

Figure 29:
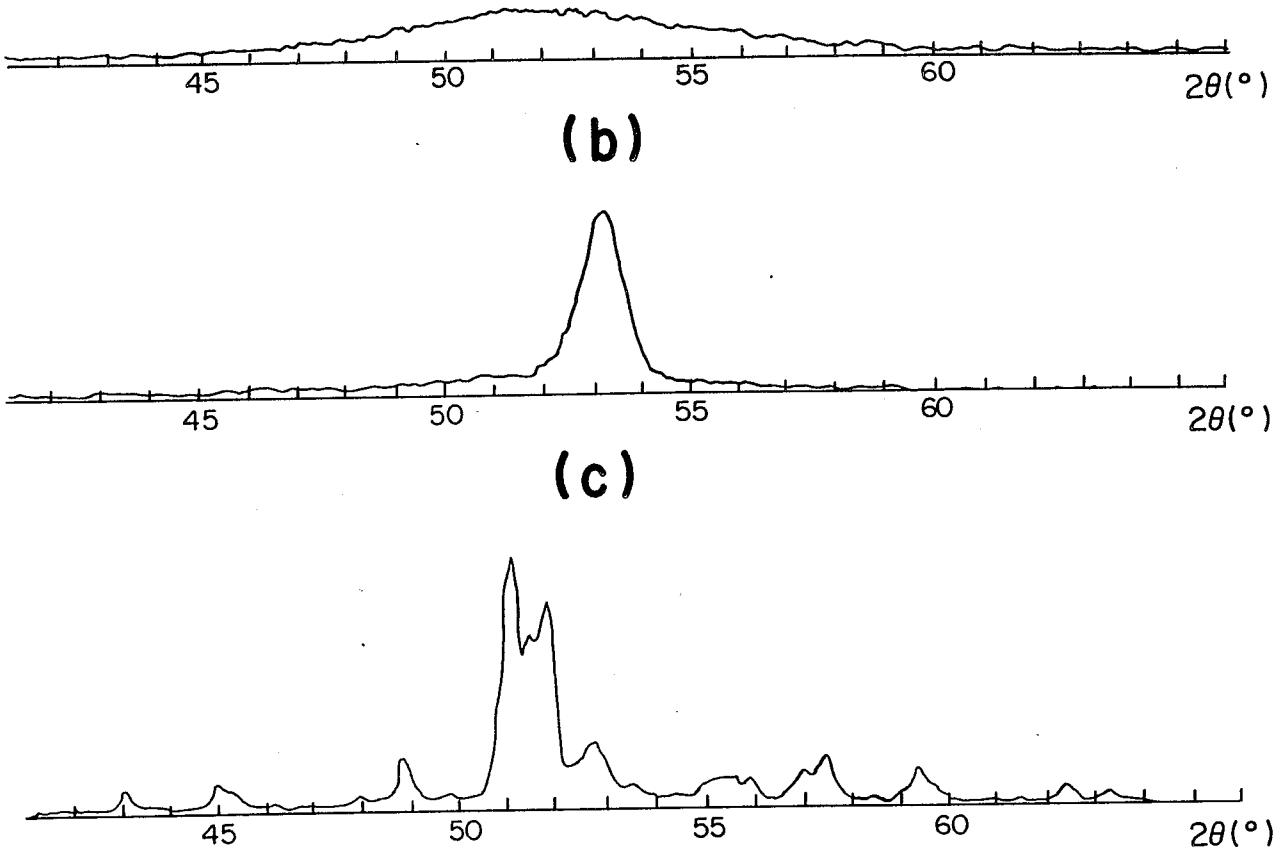
FIGS. 29 (*a*)–(*c*) are graphs showing the X-ray diffraction pattern of the Fe-base soft magnetic alloy of Example 40.

FIG. 29 shows X-ray diffraction patterns, in which (*a*) shows a ribbon of the $Fe_{73.5}Cu_1Nb_3Si_{13.5}B_9$ alloy before heat treatment, (*b*) a ribbon of the $Fe_{73.5}Cu_1Nb_3Si_{13.5}B_9$ alloy after heat treatment at 550° C. for one hour, (*c*) a ribbon of the $Fe_{74.5}Nb_3Si_{13.5}B_9$ alloy after heat treatment at 550° C. for one hour.

FIG. 29 (*a*) shows a halo pattern peculiar to an amorphous alloy, which means that the alloy is almost completely in an amorphous state. The alloy of the present invention denoted by (*b*) shows peaks attributable to crystal structure, which means that the alloy is almost crystallized. However, since the crystal particles are fine, the peak has a wide width. On the other hand, with respect to the alloy (*c*) obtained by heat-treating the amorphous alloy containing no Cu at 550° C., it is crystallized but it shows the different pattern from that of (*b*) containing Cu. It is presumed that compounds are precipitated in the alloy (*c*). The improvement of magnetic properties due to the addition of Cu is presumably due to the fact that the addition of Cu changes the crystallization process which makes it less likely to precipitate compounds and also prevents the crystal particles from becoming coarse.

EXAMPLE 41

An amorphous alloy ribbon of $Fe_{73.1}Cu_1Si_{13.5}B_9Nb_3Cr_{0.2}C_{0.2}$ of 5 mm in width and 15 μm in thickness was prepared by a single roll method.

Next, each amorphous alloy ribbon was wound to form a toroidal wound core of 19 mm in outer diameter and 15 mm in inner diameter. The resulting wound core was heat-treated in a nitrogen atmosphere under the following 3 conditions to prepare the alloy of the present invention. It was confirmed by electron microscopy that it consisted of fine crystalline structure.

Next, the heat-treated wound core was measured with respect to direct current B-H curve.

Figure 30A:
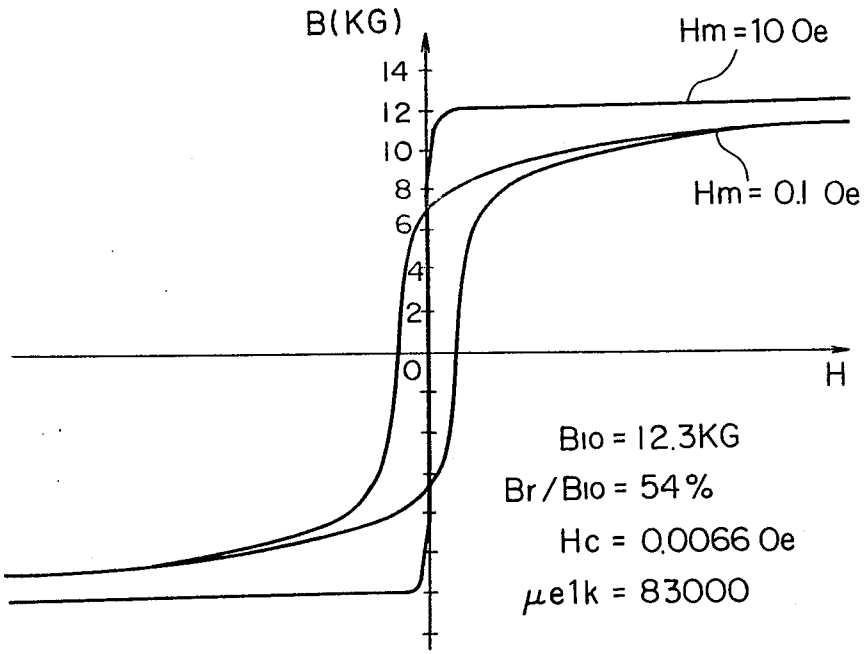
FIGS. 30 (*a*)–(*c*) are views each showing the direct current B-H curve of the Fe-base soft magnetic alloy of the present invention in Example 41.
Figure 30B:
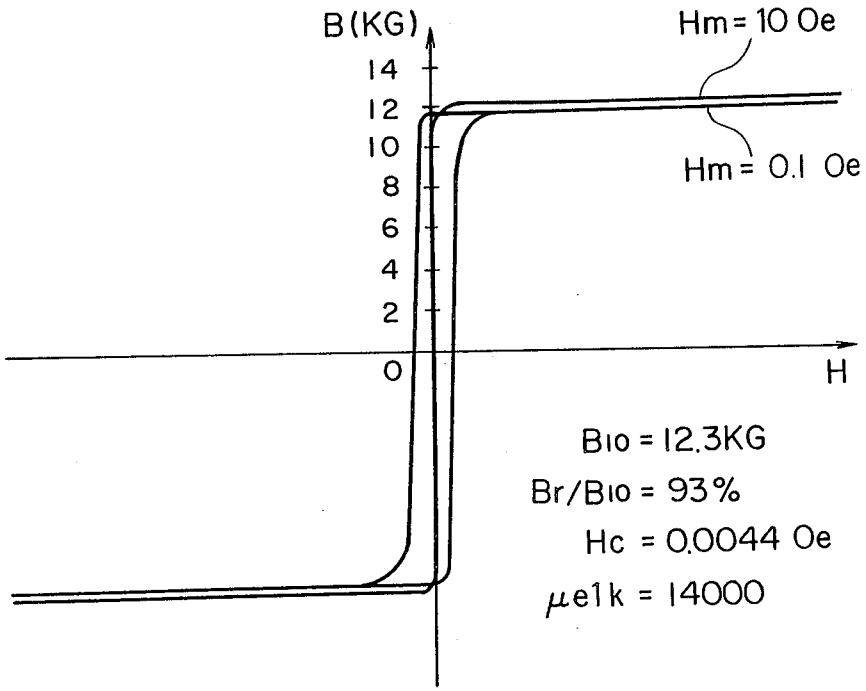
Figure 30C:
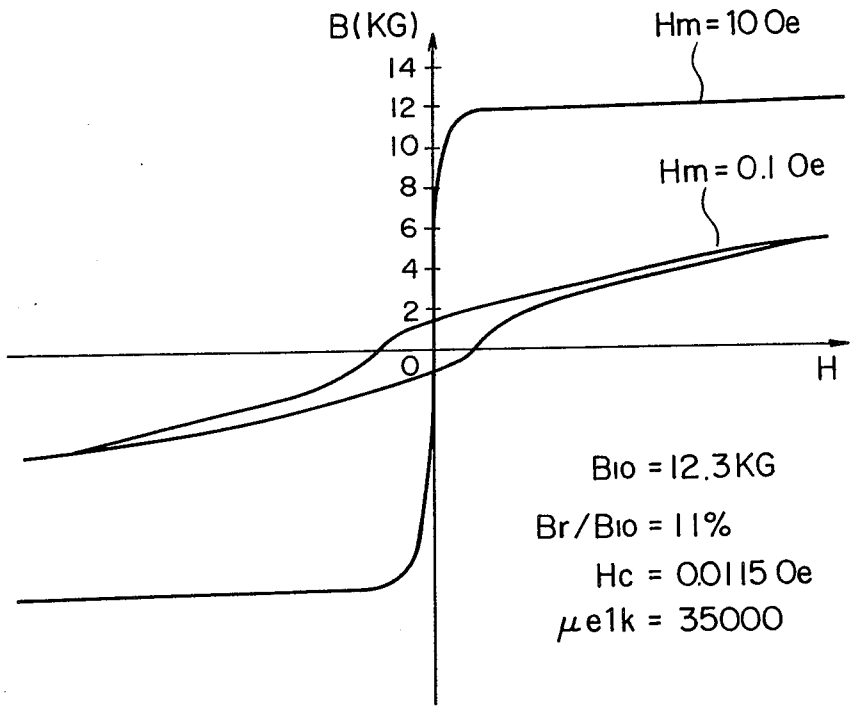

FIGS. 30 (*a*) to (*c*) show the direct current B-H curve of the wound core subjected to each heat treatment.

Specifically, FIG. 30 (*a*) shows the direct current B-H curve of the wound core subjected to the heat treatment comprising elevating the temperature at a speed of 15° C./min. in a nitrogen gas atmosphere, keeping at 550° C. for one hour and then cooling at a rate of 600° C./min. to room temperature, FIG. 30 (*b*) the direct current B-H curve of the wound core subjected to the heat treatment comprising elevating the temperature from room temperature at a rate of 10° C./min. in a nitrogen gas atmosphere while applying a DC magnetic field of 15 Oe in parallel to the magnetic path of the wound core, keeping at 550° C. for one hour and then cooling to 200° C. at a rate of 3° C./min., and further cooling to room temperature at a rate of 600° C./min., and FIG. 30(*c*) the direct current B-H curve of the wound core subjected to the heat treatment comprising elevating temperature from room temperature at a rate of 20° C./min. in a nitrogen gas atmosphere while applying a magnetic field of 3000 Oe in perpendicular to the magnetic path of the wound core, keeping at 550° C. for one hour, and then cooling to 400° C. at a rate of 3.8° C./min. and further cooling to room temperature at a rate of 600° C./min.

Figure 31:
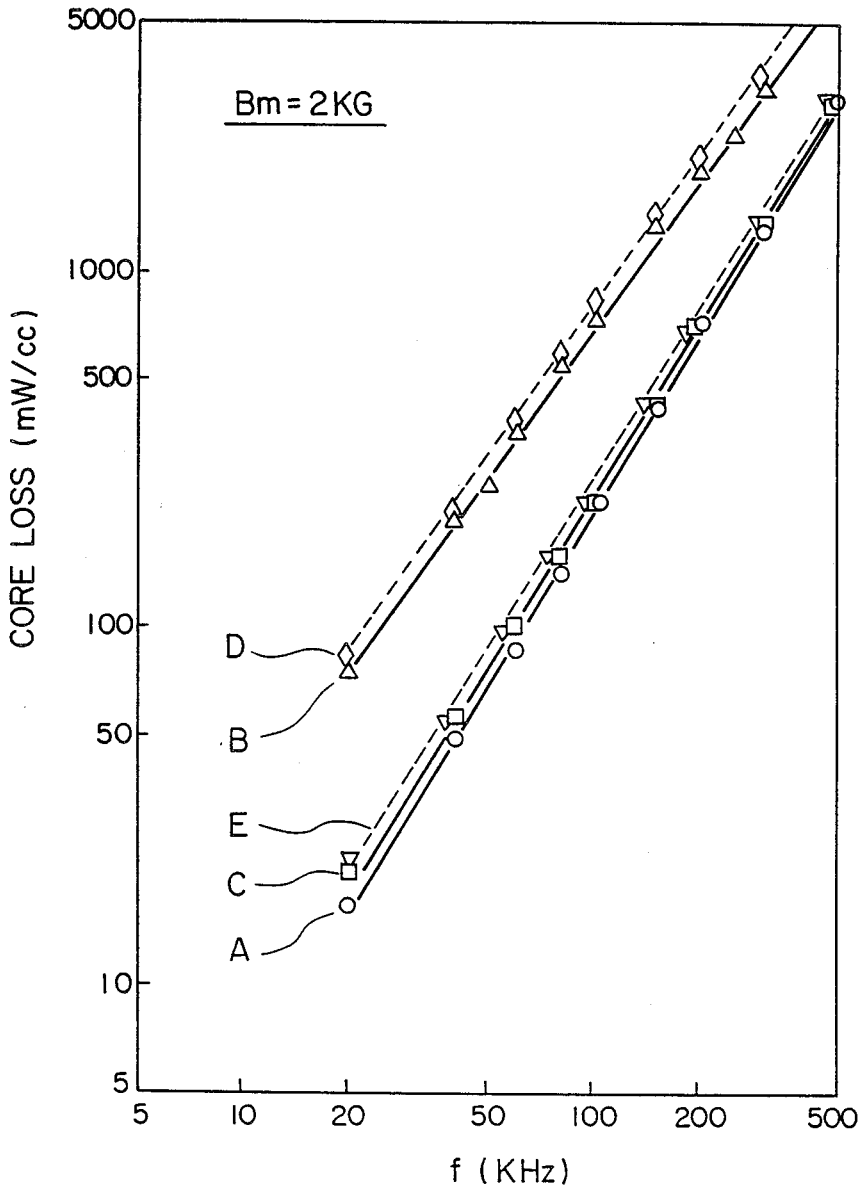
FIG. 31 is a graph showing the relations between core loss and frequency with respect to the Fe-base soft magnetic alloy of the present invention and the conventional Co-base amorphous alloy in Example 41.

FIG. 31 shows the frequency dependency of core loss of the above wound cores, in which A denotes a wound core corresponding to FIG. 30 (*a*), B a wound core corresponding to FIG. 30 (*b*) and C a wound core corresponding to FIG. 30 (*c*). For comparison, the frequency dependency Of core loss is also shown for an amorphous wound core D of $Co_{71.5}Fe_1Mn_3Cr_{0.5}Si_{15}B_9$ having a high squareness ratio (95%), an amorphous wound core E of $Co_{71.5}Fe_1Mn_3Cr_{0.5}Si_{15}B_9$ having a low squareness ratio (8%).

As is shown in FIG. 30, the wound core made of the alloy of the present invention can show a direct current B-H curve of a high squareness ratio and also a dirrect current B-H curve of a low squareness ratio and constant permeability, depending upon heat treatment in a magnetic field.

With respect to core loss, the alloy of the present invention shows core loss characteristics comparable to or better than those of the Co-base amorphous alloy wound cores as shown in FIG. 31. The alloy of the present invention has also a high saturation magnetic flux density. Thus, the wound core having a high squareness ratio is highly suitable for saturable reactors used. in switching power supplies, preventing spike voltage, magnetic switches, etc., and those having a medium squareness ratio or particularly a low squareness ratio are highly suitable for high-frequency transformers, choke coils, noise filters, etc.

EXAMPLE 42

Figure 32:
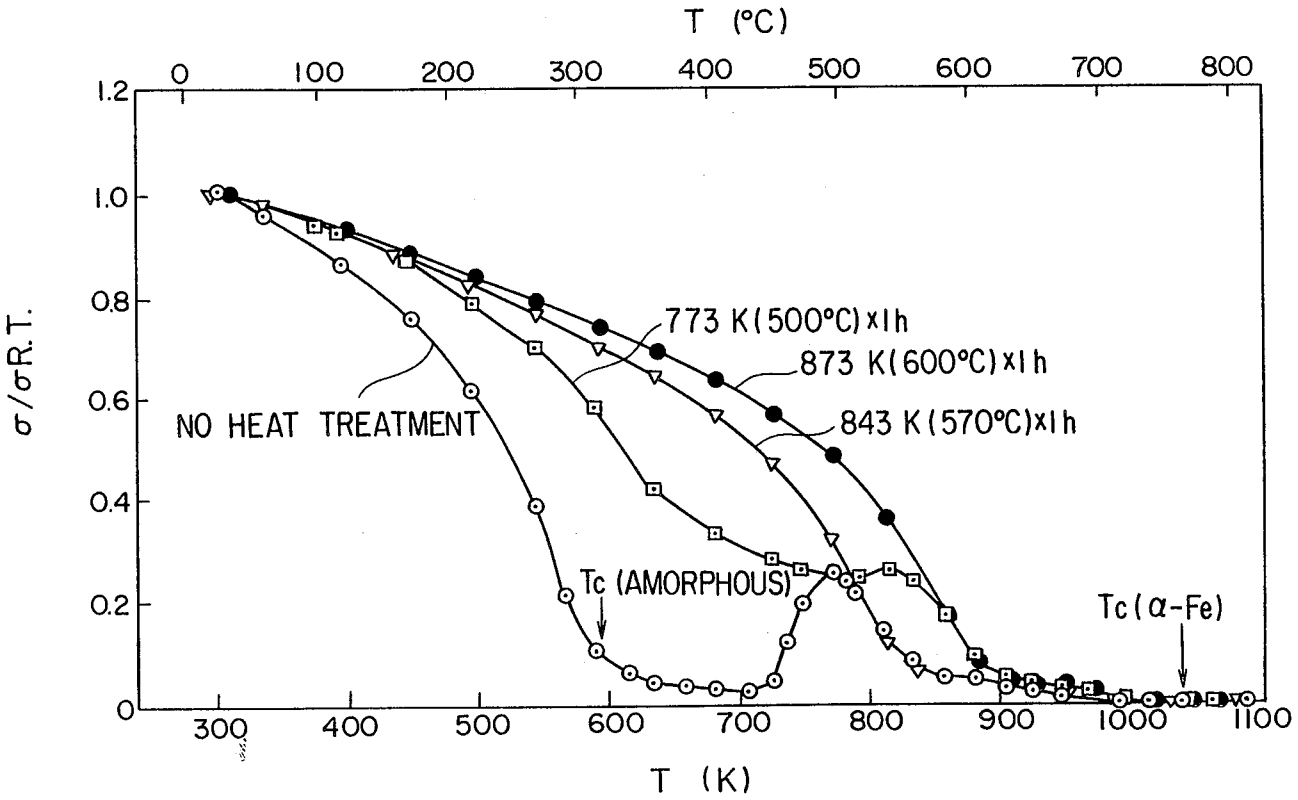
FIG. 32 is a graph showing the relations between magnetization and temperature with respect to the Fe-base soft magnetic alloy of Example 42.

An amorphous alloy ribbon of $Fe_{73.5}Cu_1Nb_3Si_{13.5}B_9$ having a thickness of 20 μm and a width of 10 mm was prepared by a single roll method and heat-treated at 500° C. for one hour. The temperature variation of magnetization of the amorphous alloy ribbon was measured by VSM at Hex=800 kA/m and at a temperature-elevating speed of 10 k/min. For comparison, the temperature variation of magnetization was also measured for those not subjected to heat treatment. The results are shown in FIG. 32 in which the abscissa shows a ratio of the measured magnetization to magnetization at room temperature $\sigma/\sigma_{R.T.}$ The alloy subjected to the heat treatment of the present invention shows smaller temperature variation of magnetization $\sigma$ than the alloy before the heat treatment which was almost completely amorphous. This is presumably due to the fact that a main phase occupying most of the alloy structure has higher Curie temperature Tc than the amorphous phase, reducing the temperature dependency of saturation magnetization.

Since the Curie temperature of the main phase is lower than that of pure α-Fe, it is presumed that the main phase consists of α-Fe in which Si, etc. are dissolved. And Curie temperature tends to increase as the heat treatment temperature increases, showing that the composition of main phase is changeable by heat treatment.

EXAMPLE 43

An amorphous alloy ribbon of $Fe_{73.5}Cu_1Nb_3Si_{13.5}B_9$ having a thickness of 18 μm and a width of 4.5 mm was prepared by a single roll method and then wound to form a toroidal wound core of 13 mm in outer diameter and 10 mm in inner diameter.

Figure 33:
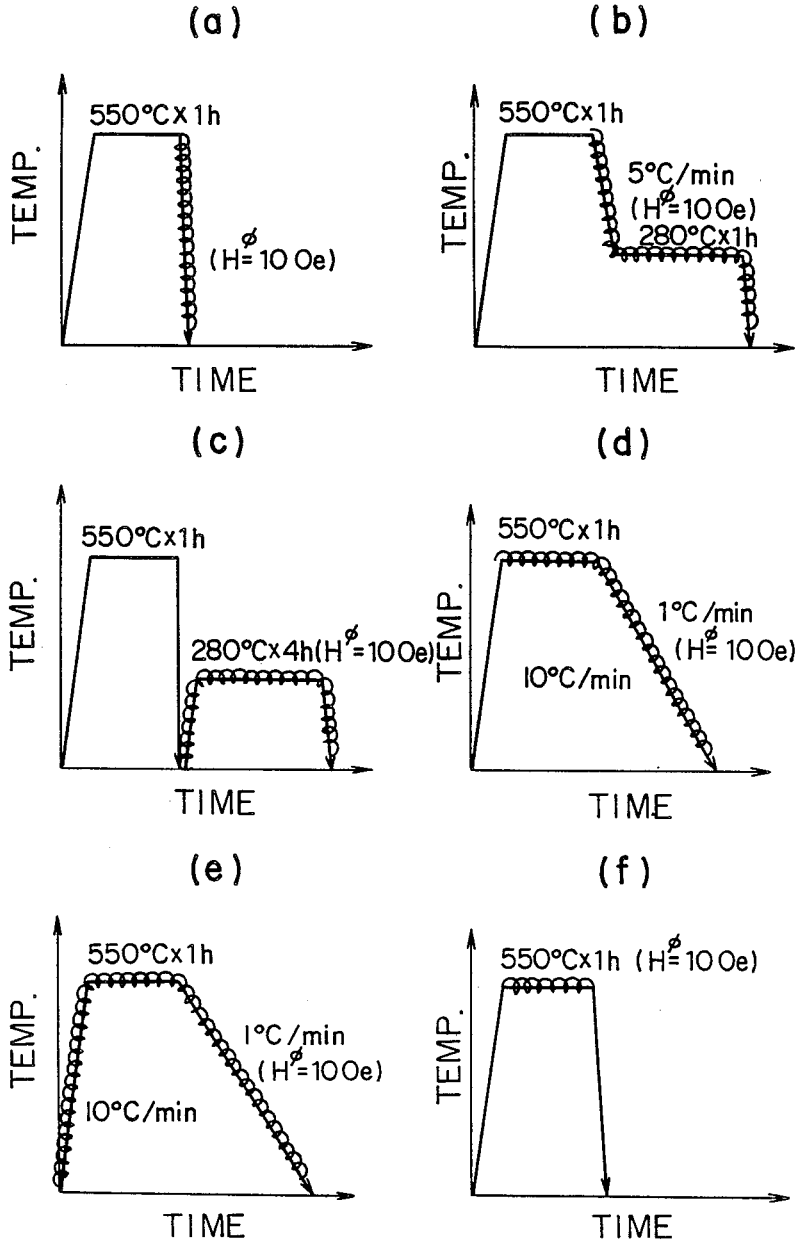
FIGS. 33 (*a*)–(*f*) are graphs showing the heat treatment pattern of the Fe-base soft magnetic alloy of the present invention in Example 43.

Next, it was heat-treated in a magnetic field according to various heat treatment patterns as shown in FIG. 33 (magnetic field: in parallel to the magnetic path of the wound core). The measured magnetic properties are shown in Table 13.

TABLE 13

| Heat Treatment Condition | $B_{10}$ (T) | $Br/B_{10}$ (%) | $W_{2/100k}$ (mW/cc) |
|---|---|---|---|
| (a) | 1.24 | 60 | 320 |

TABLE 13-continued

| Heat Treatment Condition | $B_{10}$ (T) | $Br/B_{10}$ (%) | $W_{2/100k}$ (mW/cc) |
|---|---|---|---|
| (b) | 1.24 | 90 | 790 |
| (c) | 1.24 | 82 | 610 |
| (d) | 1.24 | 87 | 820 |
| (e) | 1.24 | 83 | 680 |
| (f) | 1.24 | 83 | 680 |

In the patter (*a*) in which a magnetic field wa applied only in the rapid cooling step, the squareness ratio was not so increased. In other cases, however, the squareness ratio was 80% or more, which means that a high squareness ratio can be achieved by a heat treatment in a magnetic field applied in parallel to the magnetic path of the wound core. The amorphous alloy of $Fe_{73.5}Cu_1Nb_3Si_{13.5}B_9$ showed Curie temperature of about 340° C., and the figure of (*f*) shows that a high squareness ratio can be achieved even by a heat treatment in a mganetic field applied only at temperatures higher than the Curie temperature of the amorphous alloy. The reason therefor is presumeably that the main phase of the finely crystallized alloy of the present invention has Curie temperature higher than the heat treatment temperature.

Incidentally, by a heat treatment in the same pattern in which a magnetic field is applied in perpendicular to the magnetic path of the wound core, the Fe-base soft magnetic alloy can have as low squareness ratio as 30% or less.

As described above in detail, the Fe-base soft magnetic alloy of the present invention contains fine crystalline particles occupying 50% or more of the total alloy structure, so that it has extremely low core loss comparable to that of Co-base amorphous alloys, and also has small time variation of core loss. It has also high permeability and saturation magnetic flux density and further excellent wear resistance. Further, since it can have low magnetostriction, its magnetic properties are not deteriorated even by resin impregnation and deformation. Because of good higher-frequency magnetic properties, it is highly suitable for high-frequency transformers, choke coils, saturable reactors, magnetic heads, etc.

The present invention has been described by the above Examples but it should be noted that any modifications can be made unless they deviate from the scope of the present invention defined by the claims attached hereto.

What is claimed is:

1. An Fe-base soft magnetic alloy having the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti, and Mo, and a, x, y, z, and $\alpha$ respectively satisfy $0 \leqq a \leqq 0.5$, $0.1 \leqq x \leqq 3$, $0 \leqq y \leqq 30$, $0.1 \leqq z \leqq 25$, $5 \leqq y+z \leqq 30$ and $0.1\alpha \leqq 30$, at least 50% of the alloy structure being occupied by fine crystalline particles having an average particle size of 1000 Å or less.

2. The Fe-base soft magnetic alloy according to claim 1. wherein the balance of said alloy structure is substantially amorphous.

3. The Fe-base soft magnetic alloy according to claim 1, wherein said alloy structure is substantially composed of said fine crystalline particles.

4. The Fe-base soft magnetic alloy according to claim 1, wherein said a, x, y, z and $\alpha$ respectively satisfy $0 \leqq a \leqq 0.1$, $0.1 \leqq x \leqq 3$, $6 \leqq y \leqq 25$, $2 \leqq z \leqq 25$, $14 \leqq y+z \leqq 30$ and $0.1 \leqq \alpha \leqq 10$ and having low magnetostriction.

5. The Fe-base soft magnetic alloy according to claim 1, wherein said a, x, y, z and $\alpha$ respectively satisfy $0 \leqq a \leqq 0.1$, $0.5 \leqq x \leqq 2$, $10 \leqq y \leqq 25$, $3 \leqq z \leqq 18$, $18 \leqq y+z \leqq 28$ and $2 \leqq \alpha \leqq 8$.

6. The Fe-base soft magnetic alloy having a low magnetostriction according to claim 5, wherein said a, x, y, z and $\alpha$ respectively satisfy $0 \leqq a \leqq 0.05$, $0.5 \leqq x \leqq 2$, $11 \leqq y \leqq 24$, $3 \leqq z \leqq 9$, $18 \leqq y+z \leqq 27$ and $2 \leqq \alpha \leqq 8$.

7. The Fe-base soft magnetic alloy having a low magnetostriction according to claim 5, wherein said M' is Nb.

8. The Fe-base soft magnetic alloy according to claim 5, wherein the balance of said alloy structure is substantially amorphous.

9. The Fe-base soft magnetic alloy having a low magnetostriction according to claim 5, wherein said alloy structure substantially consists of fine crystalline particles.

10. The Fe-base soft magnetic alloy according to claim 1, wherein said fine crystalline particles have an average particle size of 500 Å or less.

11. The Fe-base soft magnetic alloy according to claim 10, wherein said fine crystalline particles have an average particle size of 200 Å or less.

12. The Fe-base soft magnetic alloy having a low magnetostriction according to claim 10, wherein said crystalline particles have an average particle size of 50–200 Å.

13. The Fe-base soft magnetic alloy having a low magnetostriction according to claim 5, wherein said crystalline particles ar mainly composed of an iron solid solution having a bcc structure.

14. The Fe-base soft magnetic alloy having a low magnetostriction according to claim 5, having a saturation magnetostriction $\lambda s$ between $-5\times10^{-6}$ and $+5\times10^{-6}$.

15. The Fe-base soft magnetic alloy according to claim 14, wherein said saturation magnetostriction $\lambda s$ is in the range of $-1.5\times10^{-6}$–$+1.5\times10^{-6}$.

16. An Fe-base soft magnetic alloy having the composition represented by the general formula:

$$(Fe_{1-a}M_a)_{100-x-y-z-\alpha-\beta-\gamma}Cu_xSi_yB_zM'_\alpha M''_\beta X_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As and a x, y, z, $\alpha$, $\beta$ and $\gamma$ respectively satisfy $0 \leqq a \leqq 0.5$, $0.1 \leqq x \leqq 3$, $0 \leqq z \leqq 25$, $5 \leqq y+z \leqq 30$, $0.1 \leqq \alpha 30$, $\beta \leqq 10$ and $\gamma \leqq 10$, at least 50% of the alloy structure being fine crystalline particles having an average particle size of 1000 Å or less.

17. The Fe-base soft magnetic alloy according of claim 16, wherein said a, x, y, z, $\alpha$, $\beta$ and $\gamma$ respectively satisfy $0 \leqq a \leqq 0.1$, $0.1 \leqq x \leqq 3$, $6 \leqq y \leqq 25$, $2 \leqq z25$, $14 \leqq y+z \leqq 30$, $0.1 \leqq \alpha \leqq 10$, $\beta \leqq 5$ and $\gamma \leqq 5$.

18. The Fe-base soft magnetic alloy according to claim 16, wherein said a, x, y, z, $\alpha$, $\beta$ and $\gamma$ respectively satisfy $0 \leqq a \leqq 0.1$, $0.5 \leqq x \leqq 2$, $10 \leqq y \leqq 25$, $3 \leqq z \leqq 18$, $18 \leqq y+z \leqq 28$, $2 \leqq \alpha \leqq 8$, $\beta \leqq 5$ and $\gamma \leqq 5$.

19. The Fe-base soft magnetic alloy according to claim 16, wherein said a, x, y, z, $\alpha$, $\beta$ and $\gamma$ respectively satisfy $0 \leqq a \leqq 0.05$, $0.5 \leqq x \leqq 2$, $11 \leqq y \leqq 24$, $3 \leqq z \leqq 9$, $18 \leqq y+z \leqq 27$, $2 \leqq \alpha \leqq 8$, $\beta \leqq 5$ and $\gamma \leqq 5$.

20. The Fe-base soft magnetic alloy according to claim 16, wherein the balance of said alloy structure is substantially amorphous.

21. The Fe-base soft magnetic alloy according to claim 16, wherein said alloy structure substantially consists of fine crystalline particles.

22. The Fe-base soft magnetic alloy according to claim 16, wherein said M′ is Nb and/or Mo.

23. The Fe-base soft magnetic alloy according to claim 22, wherein said M′ is Nb.

24. The Fe-base soft magnetic alloy according to claim 16, wherein said y and z satisfy $5 \leqq y+z \leqq 10$ when $10 \leqq \alpha \leqq 30$.

25. The Fe-base soft magnetic alloy according to claim 16, wherein said crystalline particles have an average particle size of 500 Å or less.

26. The Fe-base soft magnetic alloy according to claim 16, wherein said crystalline particles have an average particle size of 200 Å or less.

27. The Fe-base soft magnetic alloy according to claim 16, wherein said crystalline particles have an average particle size of 50–200 Å.

* * * * *

UNITED STATES PATENT AND TRADEMARK OFFICE

CERTIFICATE OF CORRECTION

PATENT NO. : 4,881,989

DATED : November 21, 1989

INVENTOR(S) : Yoshihito Yoshizawa et al

It is certified that error appears in the above-identified patent and that said Letters Patent is hereby corrected as shown below:

Column 33, line 60 (Claim 1, line 8), "$0.1\alpha \leq 30$" should be --$0.1 \leq \alpha \leq 30$--.

Column 34, line 59 (Claim 16, line 12), after "$0.1 \leq x \leq 3$", insert the term --$0 \leq y \leq 30$--;

Column 34, line 59 (Claim 16, line 12), "$0.1 \leq \alpha$ 30" should be --$0.1 \leq \alpha \leq 30$--.

Column 34, line 65 (Claim 17, line 3), "$2 \leq z25$" should be --$2 \leq z \leq 25$--.

Signed and Sealed this

Ninth Day of March, 1993

*Attest:*

*Attesting Officer*

STEPHEN G. KUNIN

*Acting Commissioner of Patents and Trademarks*